US008622473B2

(12) United States Patent
Walsh

(10) Patent No.: US 8,622,473 B2
(45) Date of Patent: Jan. 7, 2014

(54) INCLUSIVE CHAIR

(76) Inventor: Susan Walsh, Dublin (IE)

( * ) Notice: Subject to any disclaimer, the term of this patent is extended or adjusted under 35 U.S.C. 154(b) by 327 days.

(21) Appl. No.: 12/996,380

(22) PCT Filed: Jun. 2, 2009

(86) PCT No.: PCT/EP2009/056760

§ 371 (c)(1),
(2), (4) Date: Feb. 14, 2011

(87) PCT Pub. No.: WO2009/147150

PCT Pub. Date: Dec. 10, 2009

(65) Prior Publication Data

US 2011/0140492 A1 Jun. 16, 2011

(30) Foreign Application Priority Data

Jun. 5, 2008 (GB) ..... 0810292.3

(51) Int. Cl.
*A47C 3/021* (2006.01)

(52) U.S. Cl.
USPC ..... 297/287; 297/290; 297/325; 297/451.3; 297/DIG. 10

(58) Field of Classification Search
USPC ..... 297/285, 287, 288, 290, 294, 295, 297/302.1, 310, 325, 447.3, 451.3, DIG. 10
See application file for complete search history.

(56) References Cited

U.S. PATENT DOCUMENTS 2,006,421 A * 7/1935 Trainor ..... 297/287
2,246,057 A 6/1941 Michaelis
D128,802 S * 8/1941 Schenfield ..... D6/372
2,264,143 A * 11/1941 Scott et al. ..... 297/288
2,273,980 A * 2/1942 Moody ..... 297/287
2,699,200 A * 1/1955 Lingle ..... 297/294
2,802,514 A * 8/1957 Ninde ..... 297/294
2,913,038 A * 11/1959 McDerby ..... 248/628

(Continued)

FOREIGN PATENT DOCUMENTS

AT 405783 B 11/1999
CA 2083642 A1 5/1993

(Continued)

OTHER PUBLICATIONS

International Search Report issued in corresponding PCT/EP2009/056760 dated Oct. 22, 2009.

*Primary Examiner* — Peter Brown
(74) *Attorney, Agent, or Firm* — Rossi, Kimms & McDowell LLP

(57) ABSTRACT

A chair includes a seat and a supporting structure associated for positioning of the seat in an orientation in which the seat has a downward inclination towards its front edge. The supporting structure includes an elongate member on each side of the chair, each member extending substantially continuously between the seat and a rearward region of the chair via a floor-engaging region of the supporting structure. Each elongate member has a generally loop-shaped configuration, with the seat end region of the elongate member overlying the opposite end region of the elongate member, and has an inherent resilience with a bias in which the seat end region is spaced from the opposite end region in the unoccupied state of the chair and the seat has the desired forwardly-downward inclination, wherein the resilience is selected such that the seat end region approaches or comes into engagement with the opposite end region when the chair is occupied.

11 Claims, 20 Drawing Sheets

(56) References Cited

U.S. PATENT DOCUMENTS

| | | | | |
|---|---|---|---|---|
| 2,981,315 | A | 4/1961 | Schaffer | |
| 3,250,569 | A | 5/1966 | Gaffney | |
| 4,688,851 | A * | 8/1987 | Whiteford | 297/313 |
| 4,690,457 | A | 9/1987 | Poncy et al. | |
| 4,729,598 | A | 3/1988 | Hess | |
| 4,907,303 | A | 3/1990 | Baird | |
| 5,375,911 | A | 12/1994 | Morrow | |
| 5,695,244 | A * | 12/1997 | Gillern et al. | 297/271.6 |
| 6,511,128 | B2 * | 1/2003 | Piretti | 297/300.4 |
| 7,997,651 | B2 * | 8/2011 | Shen | 297/287 |

FOREIGN PATENT DOCUMENTS

| | | | |
|---|---|---|---|
| CH | 156705 | | 8/1932 |
| CH | 156705 | A | 8/1932 |
| CH | 261592 | A | 5/1949 |
| EP | 0775457 | A1 | 5/1997 |
| FR | 786683 | A | 9/1935 |
| FR | 2582980 | A1 | 12/1986 |
| GB | 199698 | A | 8/1923 |
| GB | 374342 | A | 6/1932 |
| GB | 416758 | A | 9/1934 |
| GB | 476315 | A | 12/1937 |
| GB | 2183150 | A | 6/1987 |
| GB | 2191086 | A | 12/1987 |
| GB | 2460685 | B | 9/2009 |
| HU | 69569 | A2 | 9/1995 |
| JP | 4-279332 | A | 10/1992 |
| JP | 7-33142 | U | 6/1995 |
| JP | 7-033142 | U | 7/1995 |
| JP | 2001-254476 | A | 9/2001 |
| JP | 2006-149948 | A | 6/2006 |
| WO | 0135798 | A1 | 5/2001 |

* cited by examiner 4
1
65
61
12
2
11
6
5
7
91

4
1
65
2
61
12
11
6
5
7
91

3
15
4
1
66
61
66
11
12
2
6
67
67
5
7
91

3
15
66
12
1
4
66
6
61
67
2
11
67
5
7
91

1
2
3
4
4
5
5
6
7
11
12
32
33
L 1
2
3
4
5
6
8
9
11
61
63
91

INCLUSIVE CHAIR

BACKGROUND OF THE INVENTION

1. Field of the Invention

This invention relates to chairs. The invention is in particular directed to a chair in accordance with the principles of "Inclusive Design", namely one which addresses the needs of less able-bodied and encumbered users, while nonetheless also meeting the needs and expectations of all users, while at the same time not looking in any way "different" or "special". The invention is especially directed to the provision of a chair that is at least easy to get out of, as far as possible irrespective of the health and physical abilities of the user, and preferably is also easy to sit into, again as far as possible for users of all capabilities.

2. Description of the Prior Art

A traditional chair which can in certain respects be regarded as facilitating sitting and rising actions by users is the familiar rocking chair, which may have curved members engaging directly on the surface of a floor, or may have more complex arrangements involving a base structure, in order to achieve the required rocking feature, for example by a suspended structure or by curved members rocking on a fixed base.

A type of chair which is specifically targeted at the older or disabled user is the so-called "assist chair", which may incorporate features such as an inflatable cushion or cushion portion, to elevate the user wishing to get out of the chair into a disposition in which returning to a standing position from a sitting posture is facilitated.

Users facilitated by such a function include not only those suffering from a specific physical disability, but also for example pregnant women, a breast-feeding mother, or anyone holding for example a child while sitting into or rising from a chair; in other words, any person who can be regarded as encumbered in the short term.

Prior art patent specifications relevant to the field of the invention include inter alia the following:

CA-A-2083642 describes a geriatric chair providing easy patient entry and exit and a stable-restraint-free environment for a patient seated in the chair and left unattended. The chair has a floor-engaging central fulcrum, such as for example a pair of wheels or rollers, and floor-engaging rest portions, respectively forward of and to the rear of the fulcrum. When the chair is tilted forward about the fulcrum, the front floor-engaging rest portion engages the floor, so that the seat of the chair is inclined downwardly towards the front and it is easy for the patient to get in. The chair can then be tilted rearwardly until the rear floor-engaging rest portion encounters the floor, in which orientation the centre of gravity of patient and chair is to the rear of the fulcrum, with the seat sloping downwardly towards the rear. However, by no stretch of the imagination can this chair be described as anything other than "different" and "special".

EP-A-0775457 describes a chair having variable geometry, in which front and rear legs are linked by a front-to-rear member underlying the seat and pivoted to the front and rear legs such that the elongate extent of the cross-member between its pivot points with the legs is greater that the spacing between points at which the overlying seat is pivoted to the legs. A trapezoidal linkage is thus defined such that by pivoting the legs of the chair to the rear relative to the floor on which the chair stands, the seat is tilted downwardly towards the front, while pivoting the legs to the front causes the front of the seat to rise so that the seat then slopes downwardly towards the rear. The unit is called a "rocking chair".

WO-A-0135798 describes a chair in which the seat may move backwards and forwards according as a person sitting on the chair leans against the backrest of the chair or leans forwards.

U.S. Pat. No.5,695,244 describes a rocking chair of more conventional aspect, in which the seat is supported by two spaced apart side members having a continuous outer periphery, each member having a large ground-contacting arcuate region that extends forwards and upwards and turns back and overlies the ground-contacting region of the members to form armrests. The relationship between the seat and curvature of the arcuate regions is selected so that the axis of curvature of the arcuate ground-engaging region is slightly rearward of the centre of gravity of an occupied chair, thus enabling the user to change the position of the chair over a wide range of orientations.

Resilient chair structures in which a single length of material, for example a metal tube or bar, is bent into a shape having a floor-engaging elongate portion and a seat supporting portion which are interconnected by a single upright portion of the bent material, are described by U.S. Pat. No. 2,981,315 and GB-A-374342. The basic shape of the chair frame may be generally that of a U turned on its side. Armrests may be provided by a further upstanding tube portion extending upwards from the seat supporting portion and further bent around to define a generally horizontally extending armrest portion.

A development of this type of structure is described in GB-A-416758, in which the generally horizontal floor-engaging portion and the seat supporting portion are further interconnected by springy members, typically of curved configuration, with the concavity of the curve opening in the same direction as the sideways oriented U-structure. This arrangement facilitates construction of the chair from less strongly resilient materials than are required for the structures of the aforementioned U.S. Pat. No. 2,981,315 and GB-A-374342.

Examples of laminated wood products adapted to comprise springiness or to provide parts of spring structures formed from such products are described in, inter alia, the following patent specifications:

AT-B-405783 describes a spring element for furniture, in particular a couch, in which upper and lower cambered laminated wood springs are arranged so that the concave faces of the elements face one another. A two-element wood spring is also described by JP-A-2006149948 in which a similar function is achieved by two laminated wood strips which are curved gently upwardly and cross one another intermediate their ends, so that one end of each element overlies an end of the other element. Each lower end can be fixed to a structure, and a load may be supported resiliently on the upper ends.

FR-A-2582980 describes a leaf spring made from bonded laminated wood in which strips are bonded grain on grain and arranged along the axis of the leaf such that the grain of the wood is substantially parallel to the axis of the leaf spring and the bonding planes are perpendicular to the plane of the leaf spring.

HU-A-69569 describes a leaf spring made from wood in which a sprung slat is formed from a number of veneers glued together such that the thickness of the slat increases in the middle. The neutral zone of the sprung slat may incorporate a layer of at least one ply, which is thinner than the veneer strips and shorter than the sprung slat.

Examples of composite part-wooden laminates adapted to provide a combination of strength and resilience are disclosed by, inter alia, the following patent specifications:

JP-A-2001254476 describes a composite metal-wooden beam, the bending rigidity of the beam being reinforced by forming a composite in which a metal member, such as one or more metal wires, is integrated into a laminated wood material in which light and soft woods of low strength overlap in the fibre direction.

JP-A-4279332 describes a carbon fibre-reinforced laminated timber product in which at least one layer of the product comprises carbon fibre of a specified elasticity for the purpose of enabling use of the laminated material as a structural material.

Further examples of so-called "lift chairs" designed to assist individuals in rising from a seated position are described in the following specifications:

U.S. Pat. No. 4,690,457 discloses a lift chair in which a front portion of the seat is pivotally attached to the chair frame and a pneumatic cylinder is pivotally connected between a central frame member below the front portion of the seat and the seat.

U.S. Pat. No. 4,907,303 provides an orthopedic chair with a seat pivoted at the front to the frame of the chair. A spring mechanism biases the seat towards an upwardly pivoted orientation.

U.S. Pat. No. 4,729,598 describes a convalescent chair in which a seat support structure pivotally connected to the forward portion of the seat structure is elevated by a motorized jack from a horizontal position to an inclined position to assist in raising a patient from a seated position to a standing position.

U.S. Pat. No. 3,250,569 provides a chair having a seat elevator unit by which the seat is both raised and tilted forwardly to assist a person rising from the chair. The unit is removable and may be shifted from one chair to another.

The chair of GB-A-2183150 for use by an old or infirm occupant has a seat member that can be tilted about its front edge to slope downwardly and forwardly and is connected to a similarly pivoted armrest. The tilting is operable by the occupant.

Examples of similar vehicle seat arrangements for disabled drivers include the following:

GB-A-2191086 describes driving seat for a vehicle in which the door opening is at the front of the vehicle and the vehicle controls are on a retractable steering means. The driving seat is moved from the driving position to a forward entry/exit position and has a releasable compression spring for urging the squab of the seat upwards to assist the driver into a standing position.

GB-A-199698 provides a cushioned seat for vehicles which is pivotally mounted on a framework so that its rear end may be raised to assist the occupant in rising, following which the seat reverts to its normal position in which it is downwardly inclined towards the rear.

BRIEF SUMMARY OF THE INVENTION

It is an object of the invention to provide a chair that is easy to get out of and/or to get into, but is nonetheless a normal piece of furniture and does not look "different" or "special". It is a further objective of the invention to provide a chair which will facilitate inter alia the widest diversity of users in the above respects, including the disabled, the elderly, the mobility-impaired, and those temporarily encumbered, such as pregnant women and nursing mothers, while being also suitable for and attractive to the "ordinary" user, i.e. users not falling into any of the foregoing categories.

This objective is met by a chair in accordance with claim 1. The seat of the chair may be adapted to slope downwards towards the front of the chair, in particular when a user is getting up from the chair.

Thus in a chair comprising a seat and a supporting structure for the seat, the seat and supporting structure may be associated for positioning of the seat in at least an orientation in which the seat has a downward inclination towards its front edge for facilitating at least exit from the chair. The association of seat and supporting structure required to achieve this property of the seat under exit conditions, and preferably also for entry action, when a user requires to sit in the chair, may be established by a diversity of arrangements and constructions, as now further identified and explained.

According to the invention, the desired association between seat and supporting structure is achieved by at least a portion of the supporting structure between the seat and a floor-engaging region of the supporting structure being resiliently yieldable under user weight relative to the floor-engaging region. Thus preferably the seat is adapted to have an orientation in the unoccupied state of the chair in which the desired forwardly downward positioning of the seat is achieved. A user wishing to sit into the chair may encounter the seat in a disposition conducive to a safe, comfortable and easy sitting action, while the yieldability of the structure may be adapted such that the user may engender reverse rising displacement of the seat towards the starting position, most suitably by personal weight transfer in a forward direction while still seated in the chair.

The seat may be supported on or comprised by an upper limb of a U-shaped resilient member disposed on its side, the lower limb of which forms a fixed portion of the supporting structure. In side view, the U-shaped member resembles a hairpin, and springiness is built into the member to achieve the required ease of entry and exit for the user.

In an especially favoured construction however, the supporting structure of the chair in accordance with the invention comprises an elongate member on each side of the chair, each elongate member extending substantially continuously between the seat and a rearward region of the chair via the floor-engaging region of the supporting structure. Each elongate member then suitably has a generally loop-shaped configuration in side view. In a preferred configuration of this loop shape of the member as seen in side view, each member has a generally oblong, quasi-elliptical shape, the loop being however adapted to be open in an unstressed or substantially unloaded condition of the chair, so that the opposite ends of the member are essentially free ends and are at a spacing from one another.

In a preferred embodiment of the chair, the seat end region of each elongate member overlies its opposite end region. In the unloaded condition of the chair, the end regions are spaced from one another and overlie one another at a spacing, while in the loaded condition, normally when a user is sitting in the chair, the overlying ends may come substantially into contact, depending on the weight of the user, or at least approach one another with a lesser degree of spacing between them, in the event of a lighter user.

Thus it is preferred for each elongate member to be adapted to have an inherent resilience with a bias into a configuration in which the seat end region is spaced from the opposite end region in the unoccupied state of the chair, and for the resilience of the member to be selected such that when the chair is occupied, the seat end region approaches or comes into engagement with the opposite end region. The supporting members on or by which the seat of the chair is carried then serve as spring members, and their spring characteristics are selected such that the desired entry/exit disposition of the chair is established by the unloaded condition of the springs, and the weight of a user is then taken up and absorbed or resisted by the resilience of the supporting spring members, until a force/weight equilibrium is established or the spring members bottom out by their opposed end regions coming into engagement or abutment against one another, in the event of the loading being greater than can be absorbed by the travel between the initially spaced apart free ends.

The resilience of the support arrangement for the seat is preferably achieved solely by the elongate members, but should it be desired to augment the spring force opposing the weight load exerted by a seated user, for example in a variant of the invention for very heavy users, a spring member as such may be interposed between the seat end regions of the elongate members and their opposite end regions.

While an open structure of the chair is preferred, namely one in which the free ends of the respective supporting members are fully independent of each other and there is no interaction between the respective ends of each member, other than when the end regions abut one another, a variant of the invention is also provided in which a free end of each elongate member at the opposite end region of the elongate member from the seat passes through or interacts with the seat end region of the elongate member, for stop-limited displacement of seat end region relative to the opposite end region. A construction of this kind effectively establishes a closed loop arrangement of the elongate supporting member as seen in side view, but the ends are nonetheless free to move with respect to one another within limits of travel set by stops.

A diversity of possibilities is available for mounting the seat on or attaching it to or associating it with the elongate members of the supporting structure. Thus the seat of the chair may extend in continuation of the elongate members or it may be supported on the elongate members. In both of these arrangements, the seat is therefore as it were generally on top of the support members, at least in side regions of the seat. Alternatively, the seat of the chair may be at least in part suspended from the elongate members. In this arrangement, the seat may therefore be at a lower level than the upper runs of the elongate members, as a result of which a larger curvature, of greater nominal radius or radii, may be selected for the elongate members, thus giving the potential to enhance the springiness or resilient characteristics of the supporting members. In such a construction, the front of the seat may be located at a level lower than that of the supporting members by for example bracket arms, with the upwardly extending backrest then being attached to the supporting members to extend transversely between them and thereby also fulfil a stretcher function.

In this preferred suspended-seat embodiment, the front edge of the seat may be set back between the supporting members, so that a space exists at the front of the seat between the supporting members, which is unobstructed by transverse stretchers and within which a user may stand, either preparatory to sitting into the chair, or immediately after having got out of the chair.

An alternative configuration may also be provided, however, in which the front edge of the seat is brought forward so that it extends substantially transversely to the planes of the elongate bent-around supporting members, and then either itself fulfils a stretcher function by being attached at each side at its front edge to a respective supporting member, or the front edge is underlaid by a separate transverse stretcher which then also forms a support for the front edge of the seat. In this variant, the user stands immediately in front of the chair when getting into it or after having got out of it, rather that actually between the supporting side members.

In any of the foregoing constructions of the invention incorporating elongate members, the elongate members suitably have a continuous convex curvature between the two free end regions of the members. Such continuous convex curvature facilitates the provision of an optimised spring action or resilience, while also enabling the chair of the invention to have further a rocking capability, in conjunction with its resilient features. The extent of scale of the rocking is established by the exact curved profile of the members, and may consist of a relatively gentle rocking facility, or the rocking may be more vigorous. As subsequently further adverted to, the provision of a rocking capability may also serve to augment the easy entrance/exit capability of the chair of the invention, by virtue of it being then possible for the entire chair to tilt, in addition to tilting of the seat by virtue of resilient deflection of springlike supporting members or similar features, or by structures and mechanisms of other kinds, as discussed further below.

Also in any of the foregoing embodiments having elongate supporting members, these members suitably comprise side members of the supporting structure and are cross-linked by a plurality of transverse stretchers. Transverse stretchers give lateral stiffness to the chair and are preferably positioned in all embodiments having elongate curved supporting members at least in the region of the rear free ends of the members and at one or more other locations along the lower runs of the members. The mounting of the seat, whether on or to the members or by being suspended from them, gives lateral stiffness to the upper runs of the members, and one or more stretchers may also be provided at the front of the structure, where the elongate members curve upwardly between the lower and upper runs, depending on the stiffness characteristics of the elongate members individually.

In a variant, a lower run of each elongate member may associatable with a substantially linear base stand member. Thus a structure may be provided that is basically capable of rocking displacement, but may be prevented from rocking by attachment to or mounting on base members as identified above.

In further elaboration of the properties of the chair embodying elongate supporting members, the seat is preferably associated with the supporting structure in a position such that in the unoccupied state of the chair, the elongate members adopt a configuration in which the seat has the required downward inclination towards its front edge. Thus the arrangement is such that by appropriate placement of the seat and its associated backrest, the chair assumes an orientation when unoccupied such that its centre of gravity favours the downward inclination of the front of the seat. Preferably displacement of the elongate members between their relaxed unloaded configuration and a fully loaded configuration of the elongate members in an occupied state of the chair is at least partially effectable by user weight transfer. This balance of forces is especially realisable in the case of the rocking variant of the chair by suitable location of the various component parts, including seat and backrest, in conjunction with the seat and backrest in particular being shaped and aligned such that this balance is also maintained when the chair is occupied by a user and the user can achieve exit as far as possible by his or her own weight transfer movements, substantially while in a seated position in the chair.

Finally, in regard to the elongate members, the supporting structure suitably comprises at least one laminated member. Preferably, at least each supporting member is a laminate structure comprising wood. Suitable selection of timber kind and quality, as also lamina thickness for each layer, the adhesives used, and the process technology, for example steaming, enables precise establishment of the requisite spring characteristic of the finished supporting member. Composite materials may also be used if required, for example, wood and metal, or wood with for example interposed layers of textiles or a reinforcing material such as carbon. It is also possible to vary the depth or thickness of for example a laminate which is generally rectangular in cross-section, by using strips of greater lamina thickness over part of the extent of the member, or by using additional laminas again over part of the length of the member, to give it additional thickness where for example, greater bending stiffness may be required.

In a non-passive construction of a chair of the generic kind, the seat may be tiltingly mounted on the supporting structure. In a first variant of such an arrangement, the seat may be substantially centrally pivoted to the supporting structure about a pivot axis located substantially midway between front and rear edges of the seat. Alternatively, the seat may pivoted to the supporting structure about a pivot axis located in the region of the front edge of the seat, or in a still further possibility, the seat may be pivoted to the supporting structure about a pivot axis located in the region of rear edge of the seat.

The seat may also be associated with the supporting structure for displacement of the front and rear edges of the seat relative to the supporting structure. Thus for example, pins extending laterally from the front and rear edges of the seat may engage in elongate slots in fixed members, such as legs, of the supporting structure of the chair, so that the tilting action may be achieved by simultaneous displacement of the front and rear edges of the seat.

Chairs in accordance with this alternative active construction may have a mechanism for user-controlled latching of the seat in a selected tilted disposition relative to the supporting structure and for release of the latching as required by the user. Alternatively, or in addition to a latching feature, the chair may have a mechanism for user-controlled displacement of the seat into a selected tilted disposition relative to the supporting structure. In a particular possibility, this mechanism may be a lever-actuated linkage, the lever being located at or in an armrest of the chair.

In any of the foregoing variants of the construction in which the seat is tiltable, the chair may also comprise means for biasing the seat towards the orientation in which it has a downward inclination towards its front edge. This biasing means may be accommodated within a rear supporting member of the chair and may for example be a compression spring, either a mechanically-acting coil spring, or a piston and cylinder type structure, expandable under for example gas pressure, compressible by loading such as the weight of a user sitting into the chair, and lockable at a selected degree of expansion, should such a feature be desired.

In a further option, the seat of the chair may be fixedly associated with the supporting structure and the chair may comprise means for urging the support structure towards the orientation in which the seat has a downward inclination towards its front edge. Such means may be incorporated into the supporting structure, which may for example comprise biasing means for effecting upward displacement of a rear region of the supporting structure, such as for example an expandable feature such as a sprung foot extendible under spring force from the foot of a rear leg of the chair. The supporting structure may in addition comprise means for effecting upward displacement of a front region of the supporting structure, the force exertable by the front biasing means being less than that exertable by the rear biasing means, so that the chair can be urged towards a disposition in which entry and exit is facilitated.

In all of the various embodiments and variants of the chair according to the invention, the floor-engaging portion may provide for at least limited rocking action of the chair as a whole relative to an underlying supporting floor. In such a rockable construction, the seat may however be fixedly associated with the supporting structure and the displacement of the seat into at least an orientation in which the seat has a downward inclination towards its front edge may then be established by suitable location of the centre of gravity of the chair when unoccupied. However, many other combinations of rockability with other features of the chair of the invention as described above are also feasible and are encompassed or envisaged within the scope of the present invention.

Rockability may also be established for example by the seat being suspended from the supporting structure by swing links. Alternatively a motion equivalent to rocking may also be effected by the seat being slidingly displaceable relative to the supporting structure along a substantially arcuate path which is upwardly convex. Both of these options also engender the desired easy access/exit feature of a chair of the of the generic kind.

In many of the configurations described above, the seat is displaceable into the orientation in which it has a downward inclination towards its front edge by user weight transfer. This is the case both for fully passive constructions, such as those having the laminated spring supporting members, or those which apply a rocking motion in order to facilitate entry and egress to and from the chair, as well as for those using active mechanisms, such a user-controlled springs or the like, where the action of these features can be augmented or assisted by user weight transfer.

BRIEF DESCRIPTION OF THE DRAWINGS

Passive constructions of a chair of the generic kind in accordance with the present invention are described with reference to FIGS. 26-44, these being constructions in which ease of use, especially entry and exit, is achieved without active mechanical intervention or mechanisms. Especially favoured constructions are shown in FIGS. 35 and 36, and 38-44.

FIGS. 1 and 2 show a first construction of chair of the generic kind, with the seat in horizontal and tilted dispositions respectively;

FIGS. 3 and 4 show a second construction of chair of the generic kind, with the seat in reclining and exit dispositions respectively;

FIG. 5 shows an alternative manner of mounting the seat and backrest portion for tilting displacement in a chair of the generic kind;

FIG. 6 shows a further manner of mounting the seat and backrest portion for tilting displacement in a chair of the generic kind;

FIG. 7 shows a chair of the generic kind in which the rear of the seat portion may be raised as required for forward tilt of the seat;

FIGS. 8 and 9 a further construction of chair of the generic kind in which the seat and backrest are tiltable between a reclining position, FIG. 9, and a forwardly and downwardly tilted orientation of the seat, via an intermediate position, FIG. 8;

FIG. 10 shows one possibility for a mechanism for actuating displacement of the seat and backrest of the chair of FIGS. 8 and 9 between its various dispositions;

FIGS. 11 and 12 show a chair in of the generic kind in which forward and downward tilt of the seat and backrest from the generally horizontal disposition of FIG. 11 to the inclined orientation of FIG. 12 is opposed by a spring force;

FIGS. 13, 14 and 15 show a construction of chair of the generic kind in forwardly tilted, neutral and rearwardly tilted orientations, respectively, the tilt being assisted by respective spring features associated with the legs of the chair;

FIGS. 16 and 17 show a chair of the generic kind in which the seat and backrest are suspended by swing links for movement between an exit/entry disposition, FIG. 16, and a reclining disposition, FIG. 17;

FIGS. 18 and 19 show a construction of chair of the generic kind in which movement similar to that of the chair of FIGS. 16 and 17 is achieved by sliding action of the seat and backrest on a convex path defined by the base of the chair between a forward disposition, FIG. 18, and a reclining disposition, FIG. 19;

FIGS. 20 and 21 show a passive construction of chair of the generic kind in which displacement between an entry/exit position, FIG. 20, and a reclining position, FIG. 21, is achieved by a rocking arrangement in which there are no mechanical features and bias towards the entry/exit orientation may be achieved by appropriate choice of centre of gravity for the chair when unoccupied;

FIGS. 22 and 23 show a chair of the generic kind in which a result similar to that achieved by the construction of FIGS. 21 and 22 is effected by way of a unitary pivoted seat and backrest, along with a pivoted armrest, to provide for a reclined disposition, FIG. 22, and an exit orientation, FIG. 23;

FIGS. 24 and 25 show a construction of chair of the generic kind in which the seat is underlaid by a spring member arranged so as to bias the seat towards the entry/exit orientation of FIG. 24 from a reclined disposition shown in FIG. 25;

FIGS. 31 and 32 show a further variant of chair in accordance with the invention, again exemplifying the principles incorporated in the embodiments of FIGS. 26 to 30, for an entry/exit disposition, FIG. 31, and a reclined orientation, FIG. 32;

DETAILED DESCRIPTION OF THE DRAWINGS

Figure 1:
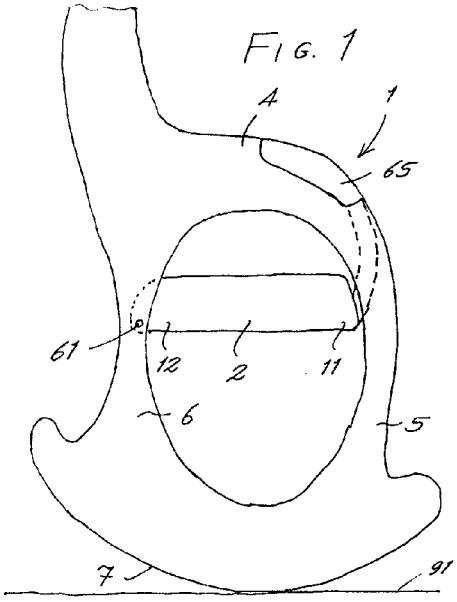
FIGS. 1-25 relate to active configurations of chairs of the generic kind, having moving parts and/or mechanical constructions, and are included to set out the developmental process underlying the evolution of the present invention and to indicate alternative manners of providing chairs of the generic kind.

A variety of constructions of chairs of the generic kind will first be described with reference to FIGS. 1-25 of the drawings, followed by description of embodiments of chairs according to the invention with reference to FIGS. 26-44. The same reference numerals are used for the same, or similar or corresponding features, in all of the exemplary constructions explained.

Figure 2:
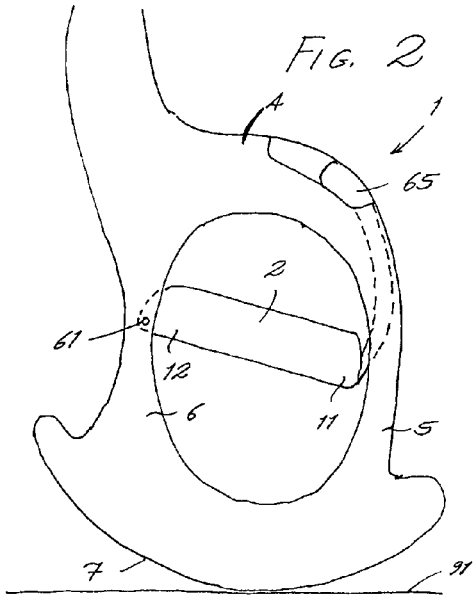

FIGS. 1 and 2 show a basic version of a chair 1 of the generic kind in a normal position for seating use, FIG. 1, and for a tilted position of the seat, FIG. 2, this representing an exit disposition when a user wishes to leave or rise from the chair. The seat 2 is pivoted 61 to the frame portion or leg 6 of the chair at the rear 12 and may be displaced downwardly at the front 11 under user control by a movable element 65 in one or both of the armrests 4. When the person seated in the chair 1 wishes to get out, he or she pushes forwardly and downwardly on these displaceable portions 65 of the armrests 4, such action representing in any case a natural reaction in the course of an exiting movement from the chair 1. An associated mechanism then moves the front 11 of the seat 2 down, so that getting out of the chair 1 is facilitated. The linkage or mechanism may be very simple, as illustrated, where a slideable sector 65 of the armrest 4 is directly connected or coupled to the front 11 of the seat 2 such as by a flexible linkage. The downward movement may be effected against a return spring, not illustrated. The downward tilt of the front 11 of the seat 2 may be augmented by the chair 1 being formed to also have a rocking feature, such as by curved underlying floor-engaging supports 7 on which the seat 2 is supported by front legs 5 and rear legs 6, so that the chair is then able to also rock forwardly on floor 91 to further assist an exiting movement as the user's weight transfers towards the front of the chair.

Figure 3:
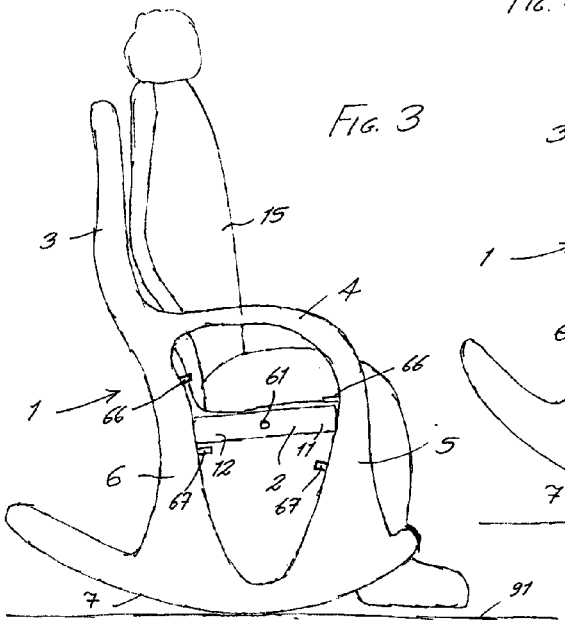
Figure 4:
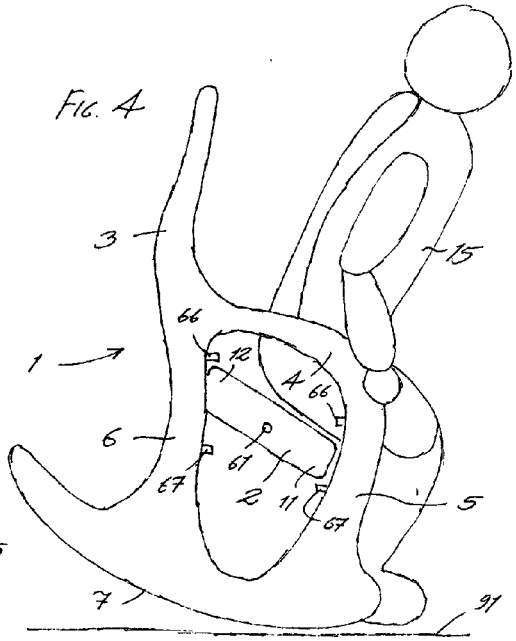

FIGS. 3 and 4 show a similar concept, but in this case the seat 2 is centre-pivoted 61 and can rotate about this pivot axis 61 within limits defined by upper 66 and lower 67 end stops provided on both the front 5 and rear 6 legs of the chair 1. No operating mechanism is provided to effect the pivoting action of the seat 2, and the movement of the seat 2 between its end stop positions delimited by features 66 and 67 takes place by user weight transfer only. When the user 15 leans forward from a reclining position against the backrest 3, shown in FIG. 3, to exit the chair 1, the seat 2 tilts down at the front 11 and the chair 1 rocks forward on curved floor supports 7, thereby facilitating the action of getting out of the chair, as depicted in FIG. 4.

Figure 5:
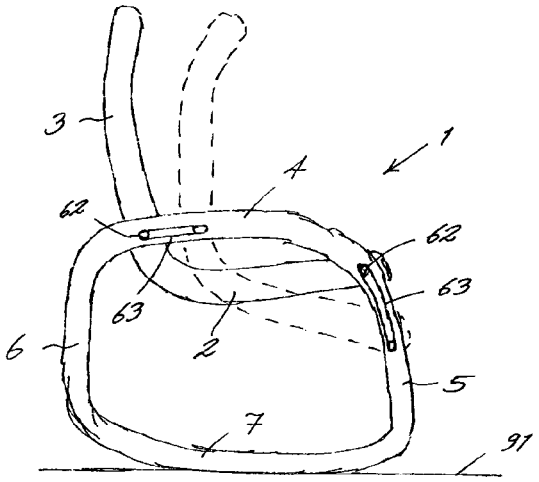

FIG. 5 shows a further conceptual arrangement in which the seat 2 and backrest 3 define a unitary structure and are guided between seated and exit positions by pins 62 extending laterally from the seat 2/backrest 3 structure at two locations along the extent of this unit, the pins 62 being guidingly engaged in elongate slots 63 in the frame of the chair 1, respectively in the front upright supports or leg portions 5 and in the armrest portions 4. The sliding and tilting action of the seat 2 may be mechanically initiated and assisted, as for the arrangement of FIGS. 1 and 2, or it may take place by weight transfer alone, as for the chair 1 of FIGS. 3 and 4, and this construction may again also incorporate an optional rocking facility. The seated or reclining disposition of the seat 2 and backrest 3 are shown in solid lines, while the tilted or exit orientation is indicated in dotted outline.

Figure 6:
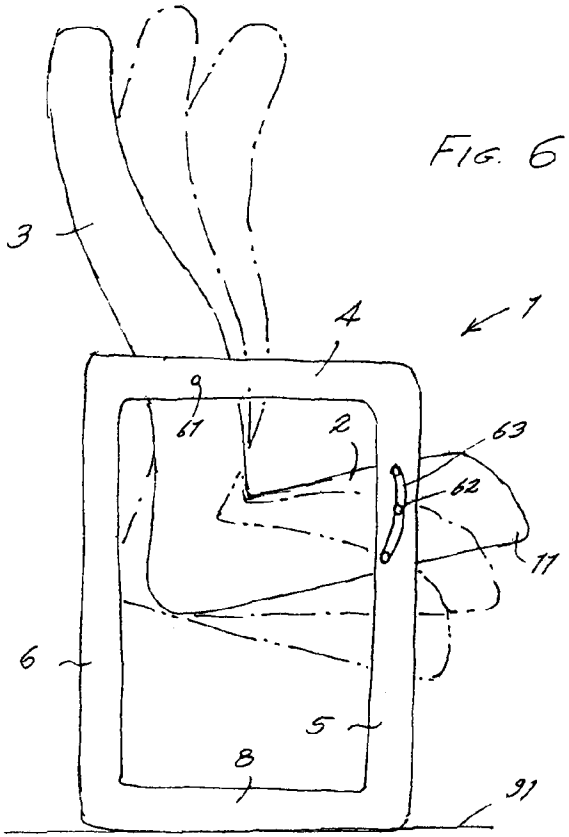
Figure 12:
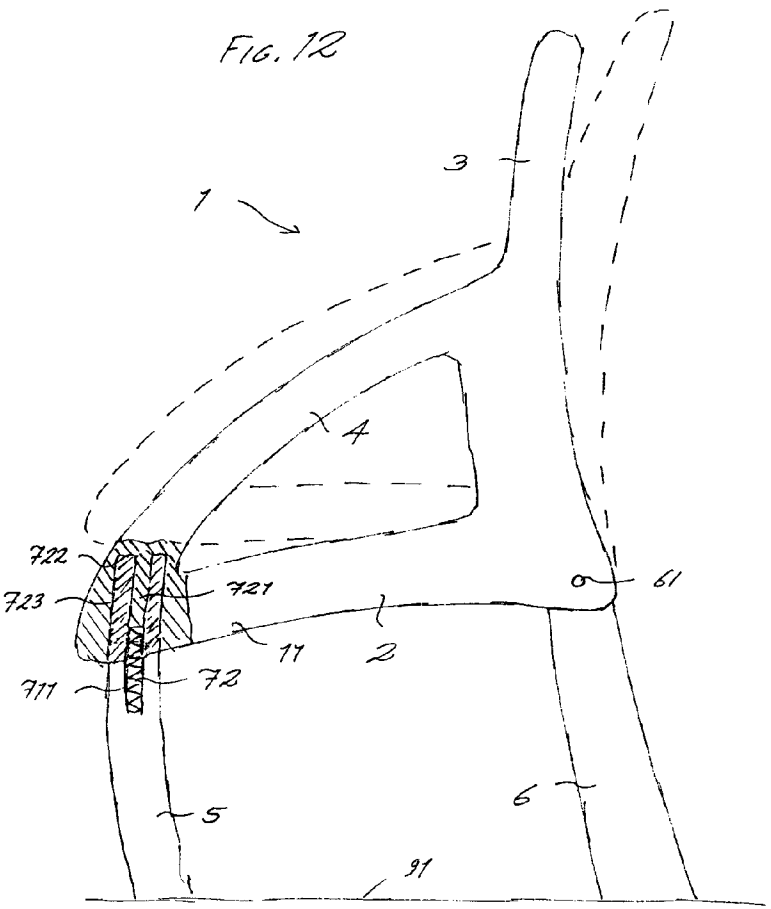

FIG. 6 shows a variant of this possibility, in which the backrest 3 is pivoted 61 to the armrests 4 and the front edge 11 of the seat portion 2 is pin-guided 62 in an arcuate slots 63 in the front leg portions 5 for upward and downward movement between an entry/exit orientation in which the front edge 11 is moved to a lower downward position and a seated orientation in which the front edge 11 occupies an upward position. In this construction, a mechanical linkage, as for the chair 1 of FIGS. 1 and 2, is favoured, preferably also with spring bias towards the upper seated orientation of the seat portion 2. The reclined position of the combined seat 2 and backrest 3 is shown in solid outline, with the downwardly sloping exit disposition of the seat 2 being depicted in double chain dot. An intermediate orientation in which the seat 2 is substantially horizontal is rendered in single chain dot. Also in this construction, the floor-engaging supports 8 are linear rather curved, so that the frame defined by armrests 4, legs 5 and 6, and supports 8 is substantially rectangular in side view.

Figure 7:
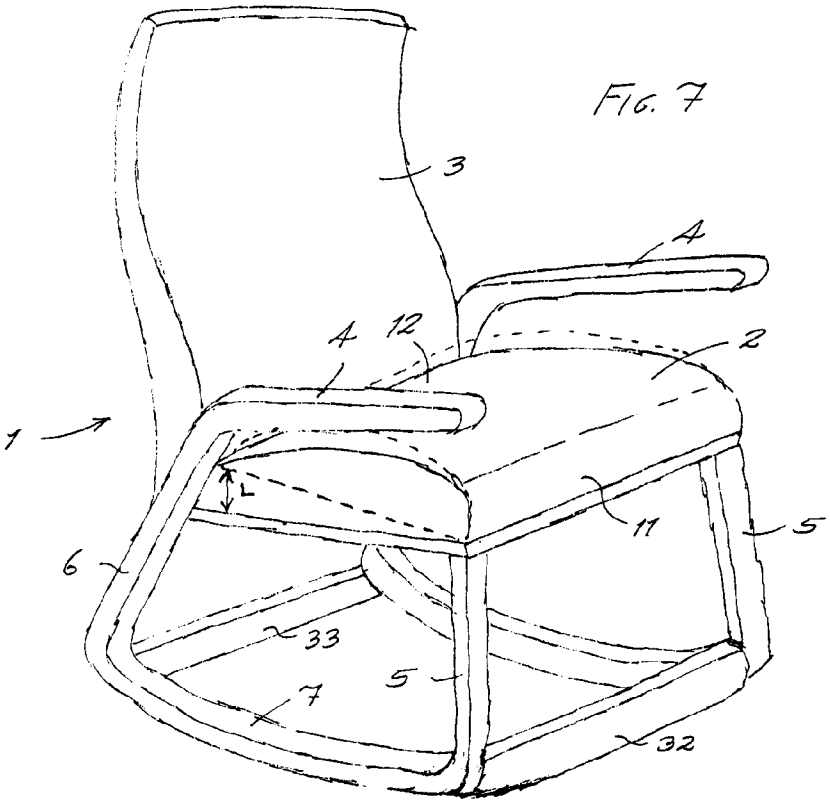

In FIG. 7, a chair 1 is provided in which the seat cushion 2 is biased at the rear 12 towards an upward position of the rear of the cushion 2, i.e. into an entry/exit position, and this bias is overcome when the user sits into the chair 1 and leans back into a reclined seated position. The upward disposition of the seat cushion 2 is indicated in dotted outline in FIG. 7, with its lower seated location shown solid. The maximum extent of the uplift is indicated by dimension "L". This upward biasing may be achieved by an underlying spring mechanism or any other suitable arrangement, adapted to be overcome by the weight of an average user, but sufficiently strong to urge the seat 2 upwardly when the user leans forwards. As shown in this drawing, the chair 1 may also be equipped with a rocking floor-engaging feature 7 to further facilitate easy entry and exit, these rockers 7 being cross-linked by front 32 and rear 33 transverse stretchers.

Figure 10:
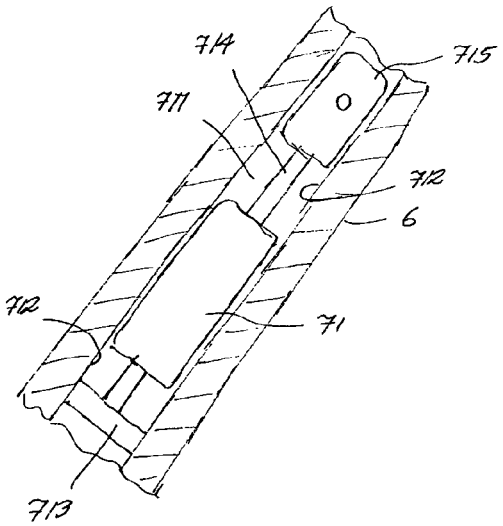
Figure 8:
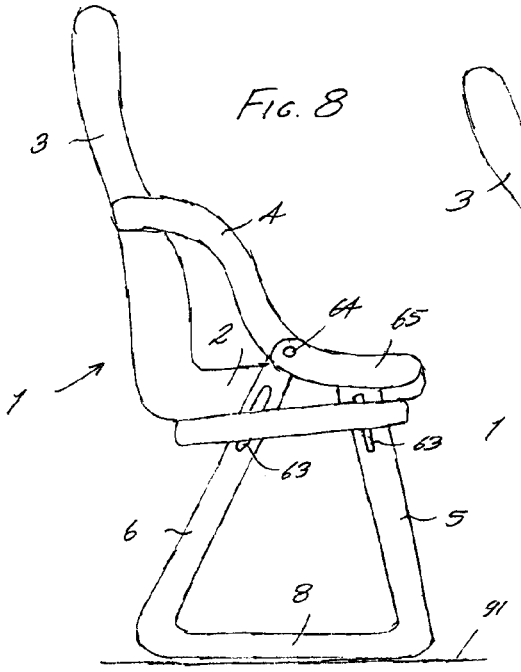
Figure 9:
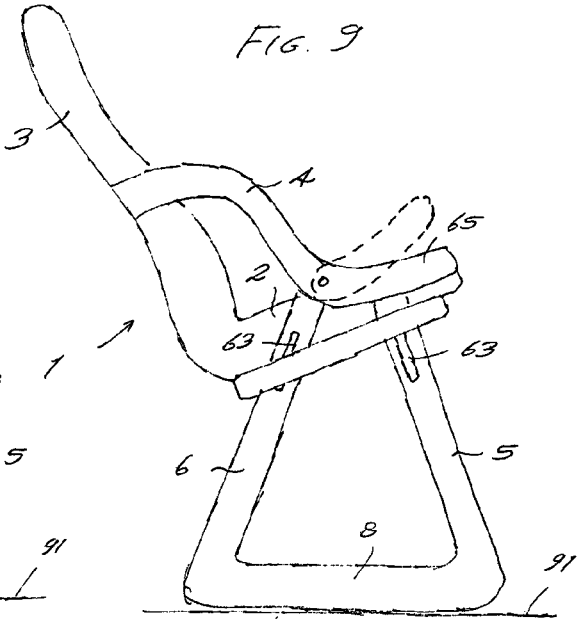

So far, there has been no specific disclosure of a mechanism by which the tilting or biasing action adverted to above may be achieved. One such possibility is shown in FIGS. 8, 9 and 10 in a non-rocking construction. Here the unitary seat 2 and backrest 3 construction may be pivoted 61 between a forward disposition and a rearward disposition under the action of a drive mechanism 71 concealed with one or both rear legs 6. The mechanism 71 comprises a gas piston and cylinder unit, similar to those used for height adjustable office chairs, this being controlled by a lever 65 incorporated in one of the armrests 4. To tilt the seat 2 into the exit position from the reclined position of FIG. 9, the user may for example, pull upwards on the lever 65 into the orientation shown in dotted outline in FIG. 9, thereby releasing the piston/cylinder mechanism 71 for expansion so as to act upwardly on the rear 12 of the seat 2 and thereby tilt it so that that the front edge 11 drops down. In the course of this displacement of seat 2, the chair will pass through the disposition shown in FIG. 8, in which the seat is substantially level. The expanding action of the piston/cylinder unit 71 is terminated by releasing the lever 65. In this construction, the armrest 4 is fixed to the backrest 3 and pivoted 64 to the rear legs 6 of the chair 1, so as to adapt to the alternative orientations of the seat 2 in reclined and exit conditions of the chair 1. The chair is non-rocking and the floor engaging members 8 extending between the bottom ends of the front 5 and rear 6 legs are linear.

Detail of a possible mechanism 71 is shown in the sectional view of FIG. 10. The unit 71 is accommodated within a chamber 711 inside a hollow portion of leg 6. The cylinder of unit 71 is secured to the walls 712 of chamber 711 such as by a transverse pin 713. Piston 714 extends from cylinder 71 and terminates with a sliding pivot link 715, for connection to the tilting seat 2.

Figure 11:
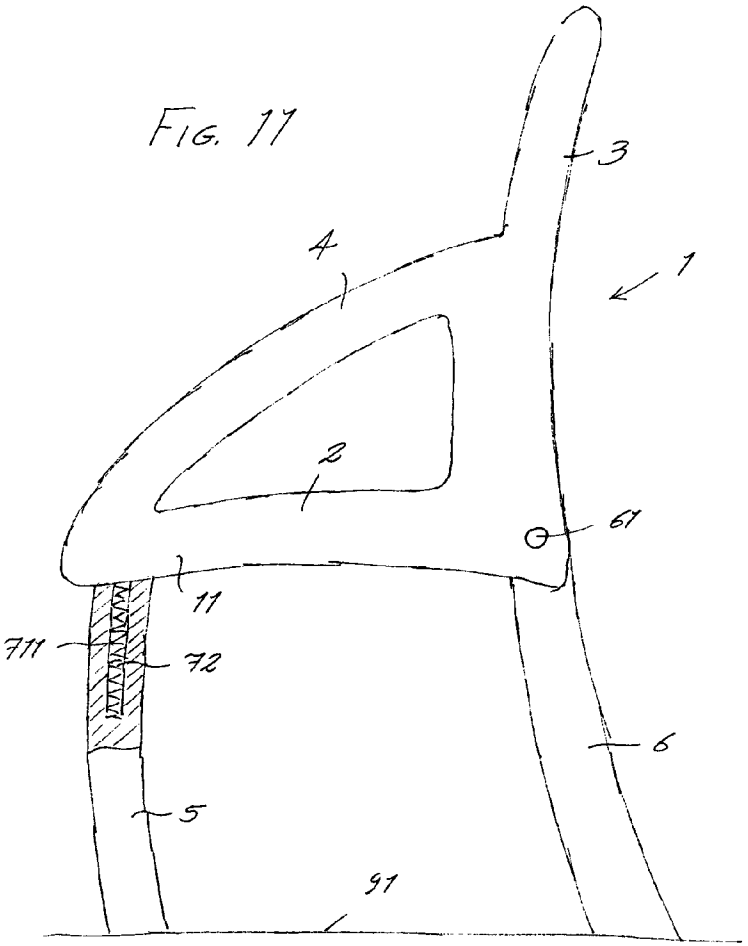

A fully passive mechanism of a generally similar kind may be effected in the manner shown in FIGS. 11 and 12, again as a static or non-rocking construction. In this variant, the seat 2 is pivoted 61 to the rear uprights 6 and the front 11 of the seat 2 is biased upwardly by a spring mechanism 72 within the front legs 5, or within at least one front leg 5. The upward position of seat 2 under this bias is shown in FIG. 11 and in dotted outline in FIG. 12. The spring bias is balanced such that a user of typical weight wishing to get out of the seat 2 can overcome the bias by shifting his or her weight forward, this establishing the tilted down orientation of the front 11 of the seat 2, shown in full outline in FIG. 12. However, this arrangement does not provide for a seat orientation in which a user intending to sit into the chair 1 encounters an initially downwardly tilted seat 2. The construction facilitates therefore exit, but entry takes place in the normal manner, with the user lowering him or herself onto the seat 2 and attaining a position of rest by leaning back. Detail of a possible interaction arrangement between the spring 72 and the seat is shown in section in FIG. 12. The spring is compressed by a downwardly extending plunger 721 extending from the front 11 of seat 2 and penetrating into the chamber 711 in leg 5 within which the spring 72 is housed. Compressive travel of this plunger is stop-limited by abutment of the end face 722 of a chamber 723 within the front end region of the seat 2, surrounding the plunger 721 and adapted to receive the top end of the leg 6, against the top of leg 6 in the region surrounding spring chamber 711.

Figure 13:
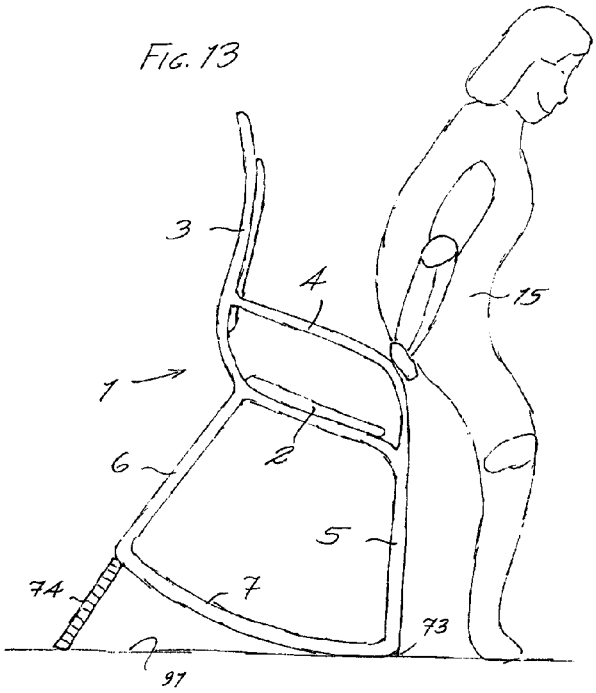
Figure 14:
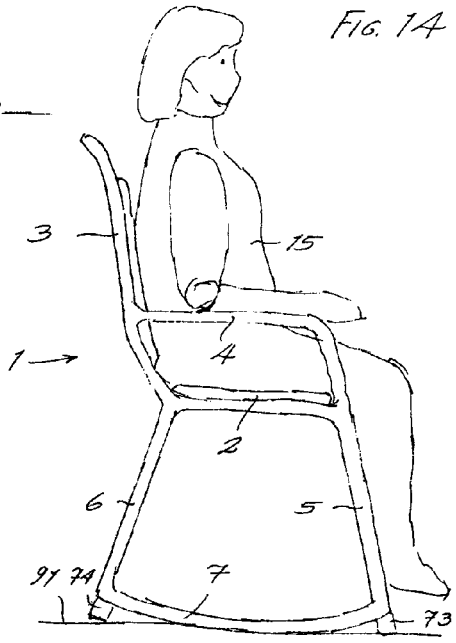
Figure 15:
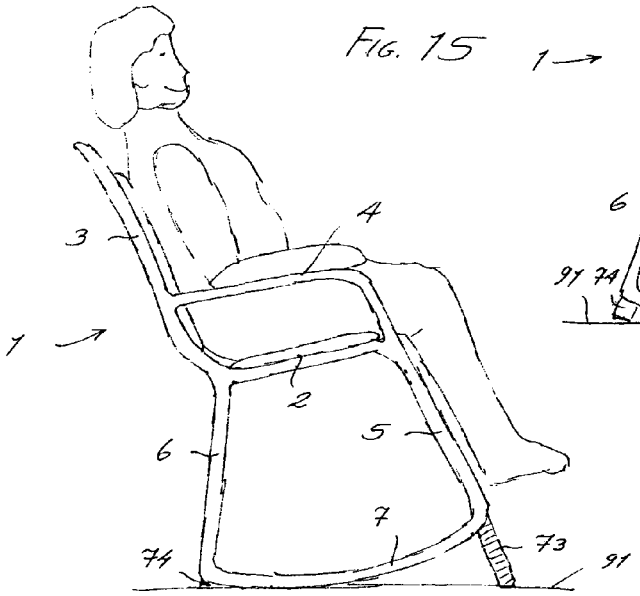

FIGS. 13, 14 and 15 show an arrangement in which the chair 1 also provides an initial entry position. The front 5 and rear 6 legs of the chair 1 are equipped with extending portions 73 and 74 respectively which can be pushed out from the respective chair leg 5 or 6 to engage against the floor 91 and tilt the chair 1 either forwards or rearwards. The chair 1 may be a passive structure in which the rear extending portion 74 is more strongly biased, such as by a compression spring or piston and cylinder feature, so that in a normal (extended) position of this rear extending portion 74, the chair 1 is tilted forwardly and the front edge 11 of the seat 2 is lowered for easy entry, FIG. 13. When a user 15 sits into the chair 1, the loading of the rear extending member 74 is overcome as the user 15 reclines back into the seat 2 and the chair 1 then moves into a neutral position, FIG. 14. Suitably, the region between the front 5 and rear 6 legs is also spanned by gently curved rocker members 7 so that the chair 1 can oscillate between forward and rearward orientations, the rearward disposition being illustrated in FIG. 15. The rocking action may be additionally facilitated and damped by the front legs 5 also being equipped with extending portions 73 that are however preferably less strongly biased than the extending portions 74 of the rear legs 6. A construction of this kind may also incorporate a triggering or latching mechanism for at least the rear extending portions 74, so that these can be latched in either or both of the extended and retracted positions. As well as compression springs, damping features may be provided to prevent the active movement of the extending portions 73, 74 from taking place with excessive speed or force.

Figure 17:
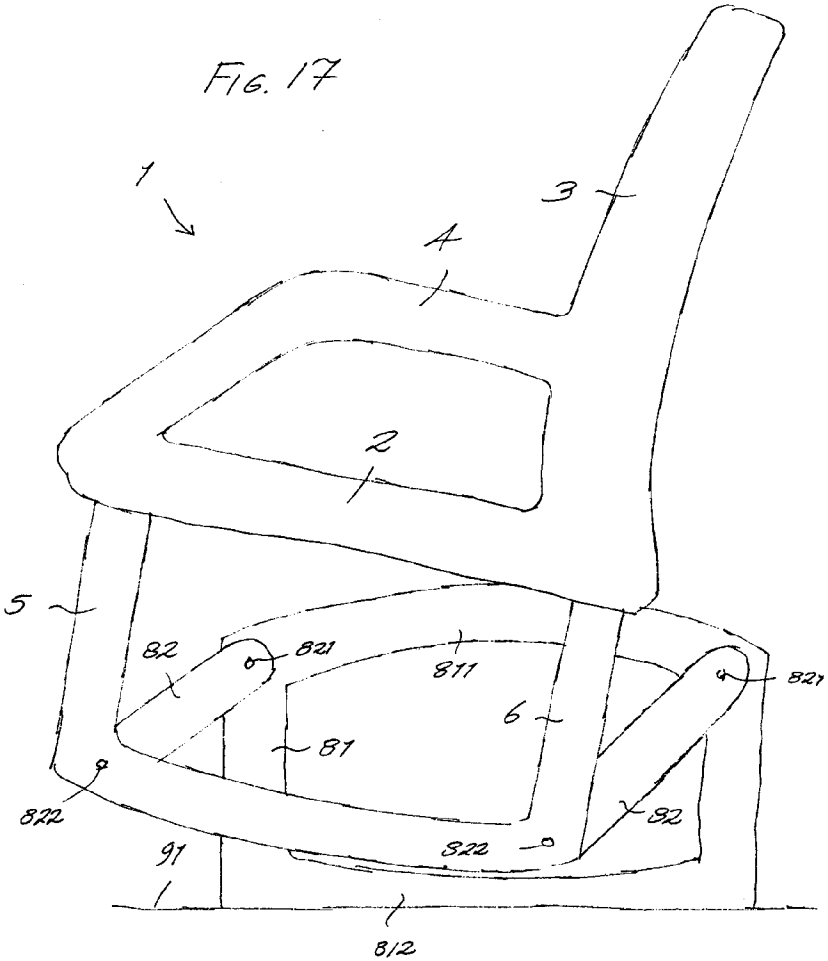
Figure 16:
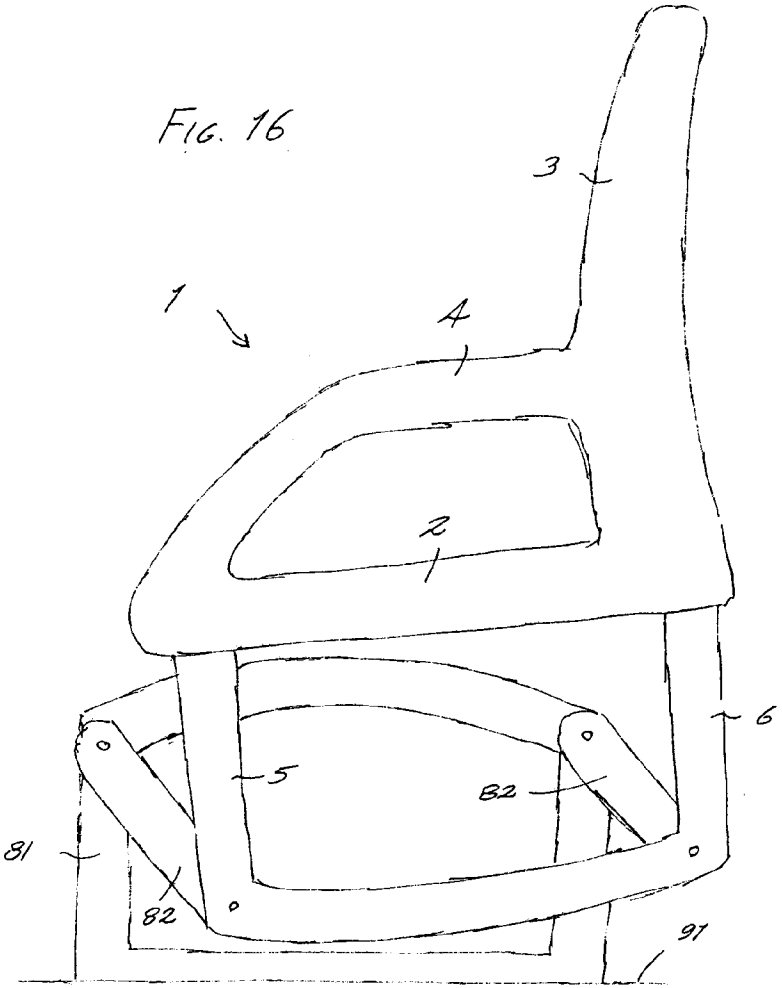

A construction in which the seat 2 and backrest 3 are suspended from a static frame 81 of the chair 1 by means of pivotally mounted swing links 82 is shown in FIGS. 16 and 17. Each swing link 82 is pivoted at 821 to an upper member 811 of frame 81, while the lower end of the swing link 82 is pivoted to the lower end of a respective leg 5 or 6 at pivot point 822. The frame 81 has a bottom linear floor-engaging support 812. While not specifically illustrated in the drawings, the chair 1 may be equipped with biasing mechanisms such as to maintain the chair in the entry position of FIG. 16, until such time as a user enters and overcomes the biasing by shifting his or her weight rearwardly, to achieve the reclining orientation shown in FIG. 17.

Figure 19:
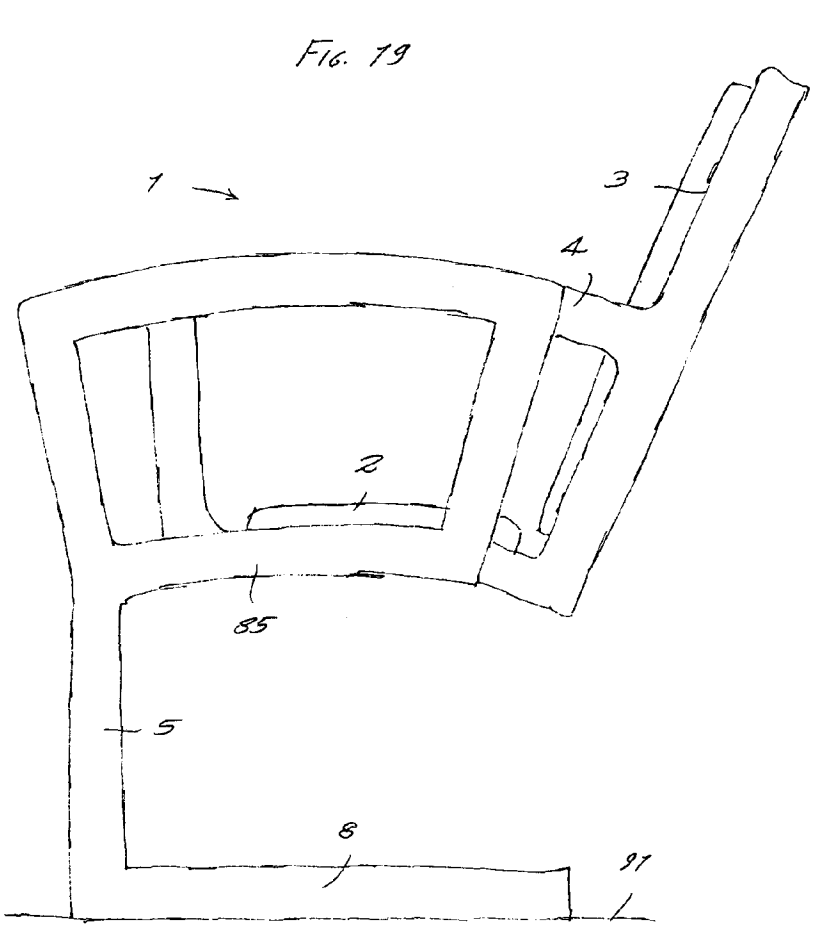
Figure 18:
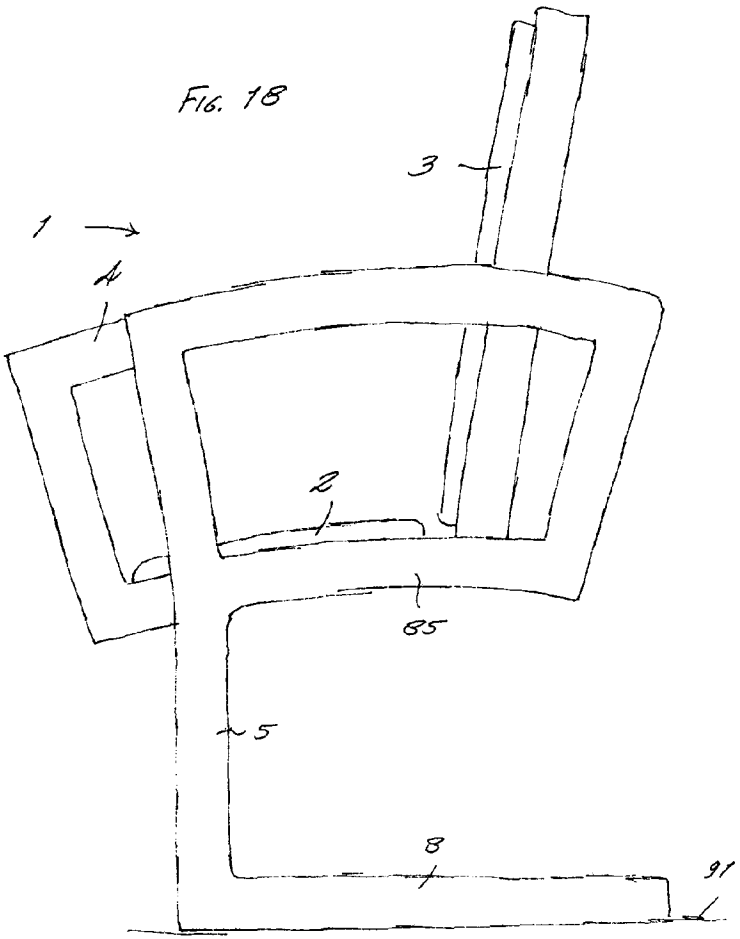

FIGS. 18 and 19 show a similar result achieved by an arrangement in which an arcuate seat structure 2, upwardly-convex, is slidingly mounted for forward and rearward movement on a likewise arcuately-shaped, upwardly-convex base structure 85. Again, spring or other biasing features may be provided so that the sliding seat unit 2 is urged forwardly towards the entry/exit position of FIG. 18, from which it may move rearwardly under the action of a user's weight or by other action to adopt the inclined of rearward orientation of FIG. 19.

Figure 21:
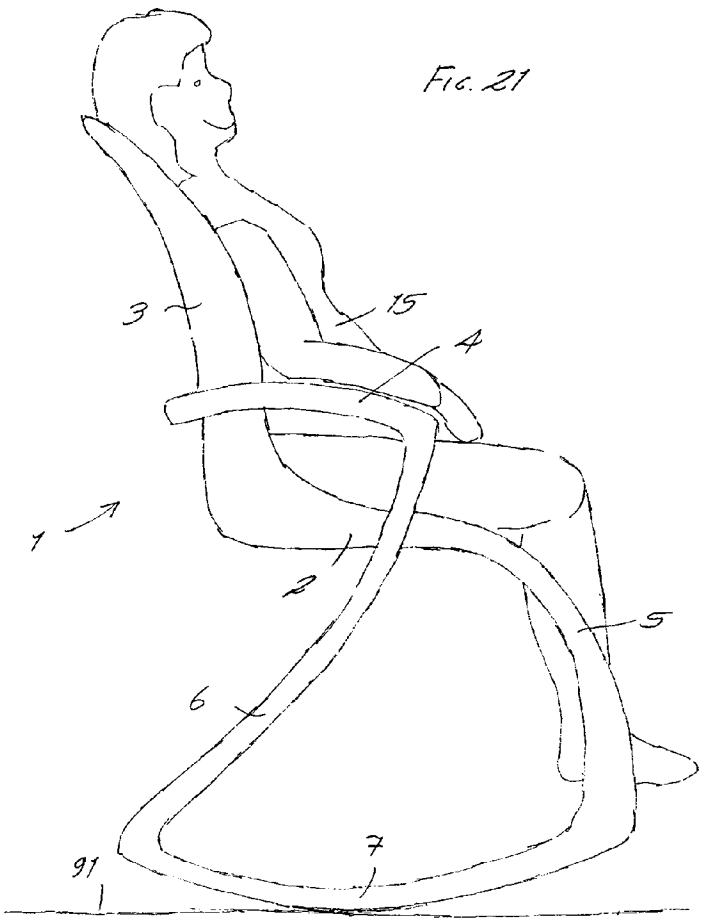
Figure 20:
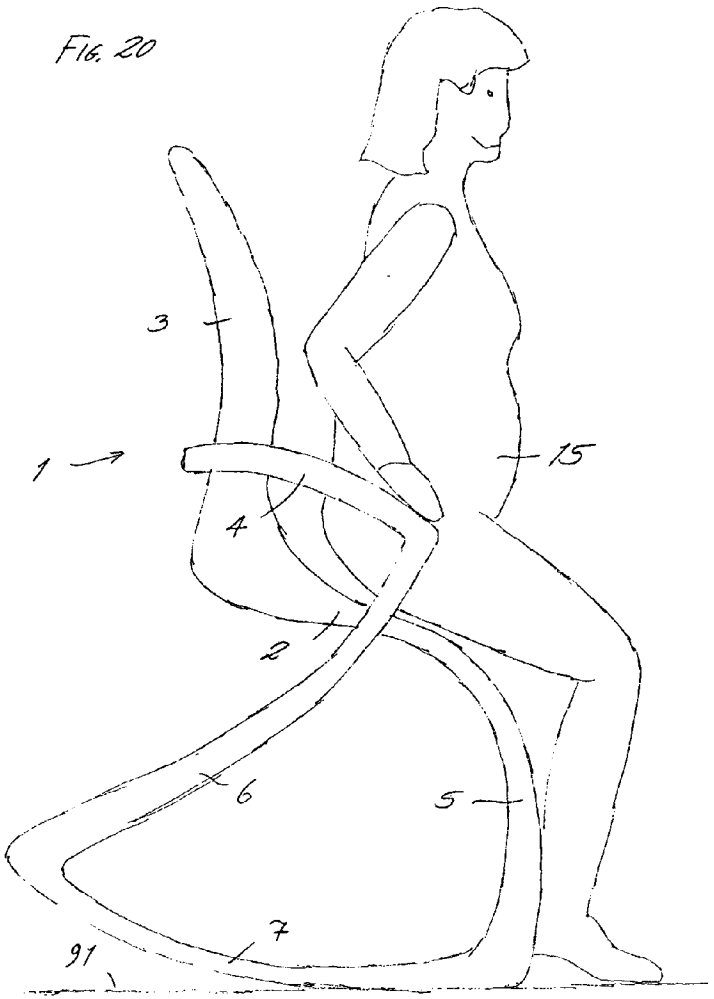

FIGS. 20 and 21 show a fully passive arrangement in which a rocking unit 1 is configured such that its centre of gravity in the unoccupied state tilts it forward into the entry/exit orientation. When a user 15 sits into the chair 1 (FIG. 20) and leans against the backrest 3, the chair 1 tilts backwards into a new stable orientation, shown in FIG. 21, on the floor-engaging curved supports 7. The chair 1 has no moving parts and the seat 2 and backrest 3 are fixedly connected to the leg-defining and base-defining portions 5, 6, 7 of the structure.

Figure 23:
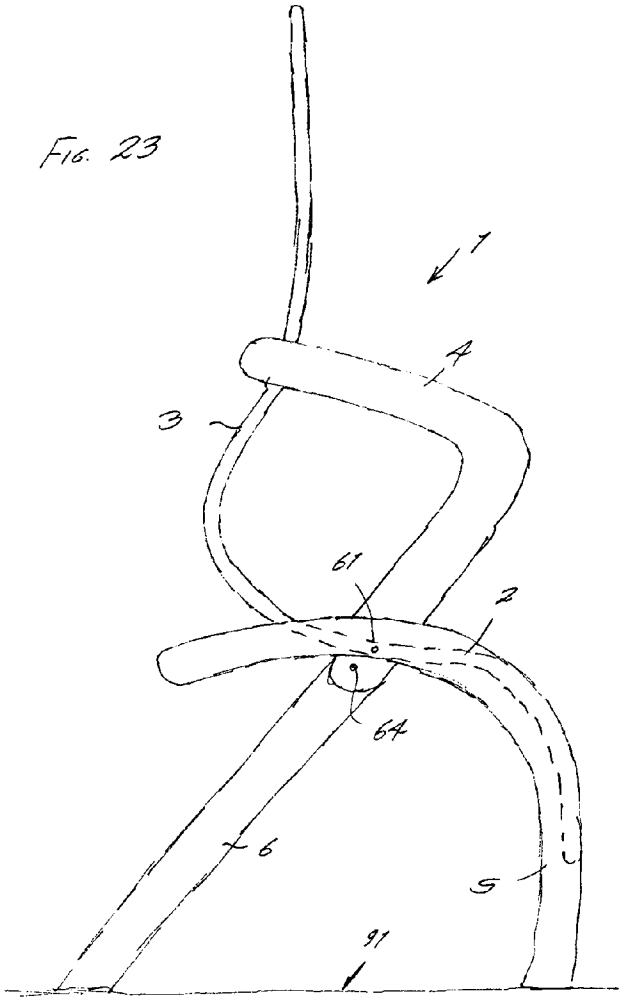
Figure 22:
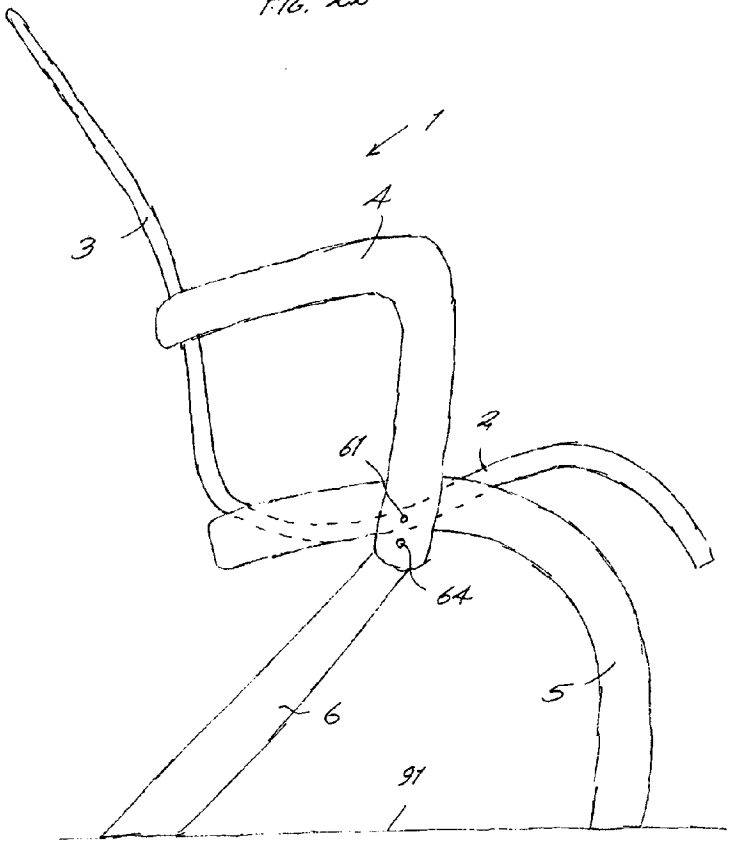

FIGS. 22 and 23 show the same effect achieved by a structure having static legs 5, 6 but with the seat 2 and backrest 3 unit pivoted 61 to the base of the chair 1. The armrest 4 is fixed to the backrest 3 and pivoted 64 to the rear legs 6 of the chair 1, so as to adapt to the alternative orientations of the seat 2 in reclined and exit conditions of the chair 1 respectively. The weight balance of the seat 2/backrest 3 combination may be such that the normal position of this unit is a forward, downwardly tilted orientation as shown in FIG. 22 and the seat 2 is tilted backwards into the occupied configuration by user weight transfer, this configuration being depicted in FIG. 23. Alternatively, the construction may incorporate an active biasing mechanism to urge the seat 2 into the forwardly tilted position.

The majority of the arrangements shown so far require a multipart construction of the chair and also for the most part various mechanical features governing the relationship between the components of the chair, for example, pivots and linkages, as well as, optionally, latching, lever and spring mechanisms, especially in order to achieve an advantageous raised and/or forwardly tilted entry disposition for the seat. This preferred seat position and orientation to facilitate sitting-in action by a user entering the chair is only partially met by solely rocking and passive constructions such as that of FIGS. 20 and 21.

Figure 25:
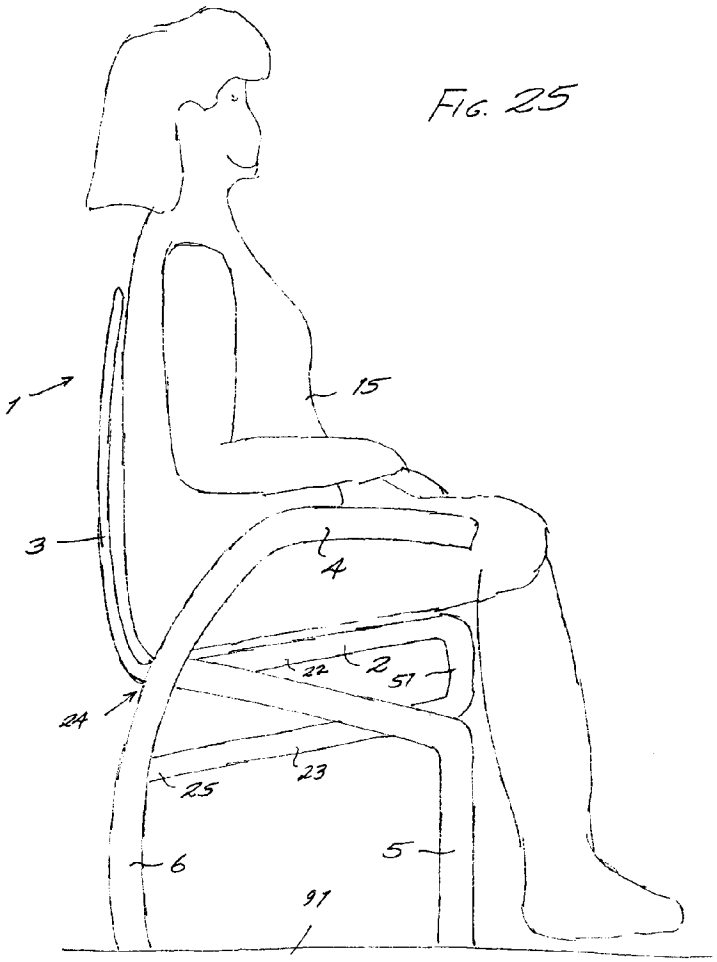
Figure 24:
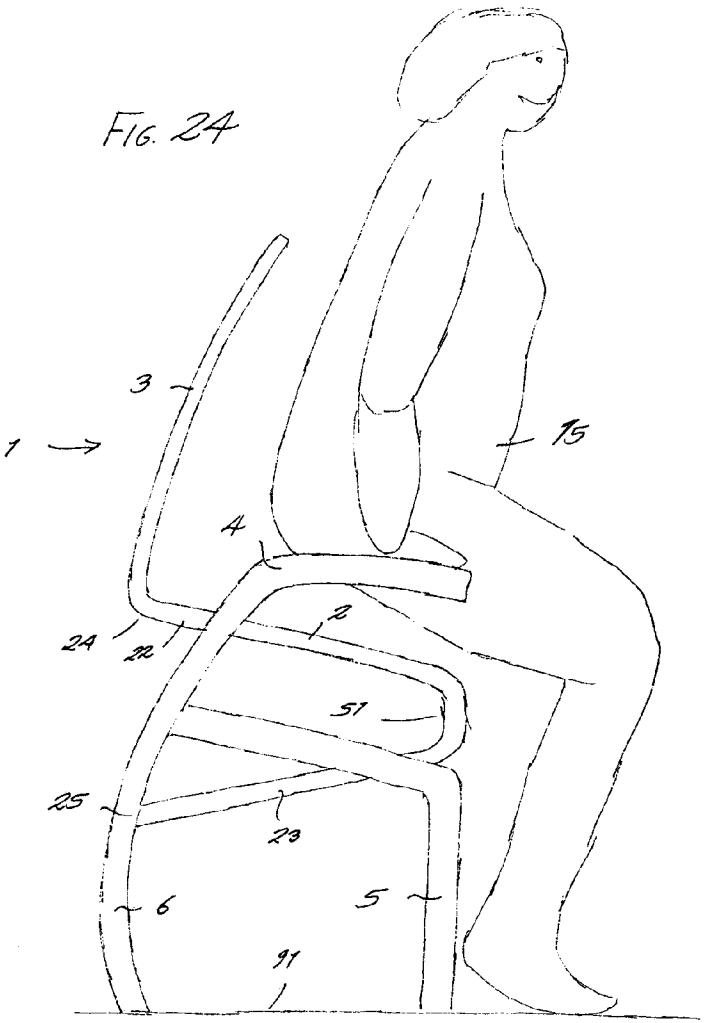

FIGS. 24 and 25 illustrate a construction in which moving parts and mechanisms are substantially dispensed with while yet achieving the required predisposition or bias of the seat to facilitate entry and exit. The seat 2 of the chair 1 is defined by one leg 22 of a generally U-shaped spring member 51, which is oriented on its side so that the mouth of the U opens towards the rear of the chair 1. The lower limb 23 of the U is secured to the static frame of the chair 1 with a downward inclination towards the rear and the spring structure is formed with an initial bias such that the upper limb 22 has an unloaded disposition in which it slopes upwardly towards the rear of the chair 1, so that the end 24 of the upper limb 22 that is remote from the base of the U 51 and is connected to the backrest 3 is spaced above the end 25 of the lower limb 23 that is remote from the base of the U 51 and is connected to the rear leg 6 of the chair at a first spacing dimension.

When the user 15 sits into the chair 1 and applies his or her weight to the seat 2 and thereby to the upper limb 22 of the U 51, this limb 22 yields resiliently under the weight force and bends downwardly, to reach a new equilibrium position in which the end 24 of the upper limb 22 is at a second spacing dimension from the end 25 of the lower limb 23 that is less than the corresponding dimension in the unloaded condition of the chair 1. In this orientation, the upper limb 22 may now be substantially parallel to the lower limb 23 of the U 51. This reclining configuration of the chair is shown in FIG. 25.

In order to stand up again and get out of the chair 1, the user 15 slides forwardly, and as the user's weight transfers forwardly, the bias within the spring member 51 causes it to expand by its legs 22, 23 moving apart, so that the seat 2 rises up and assists the user 15 in exiting the chair 1. This exit orientation, which is also an entry disposition, is shown in FIG. 24. The spring member 51 may be made from a multiplicity of suitable materials, a mixed material laminate of alternating layers of metal, e.g. steel, and wood being one possibility. Alternatively, a laminate entirely of wood may also be formulated and produced to achieve the necessary resilience.

Figure 26:
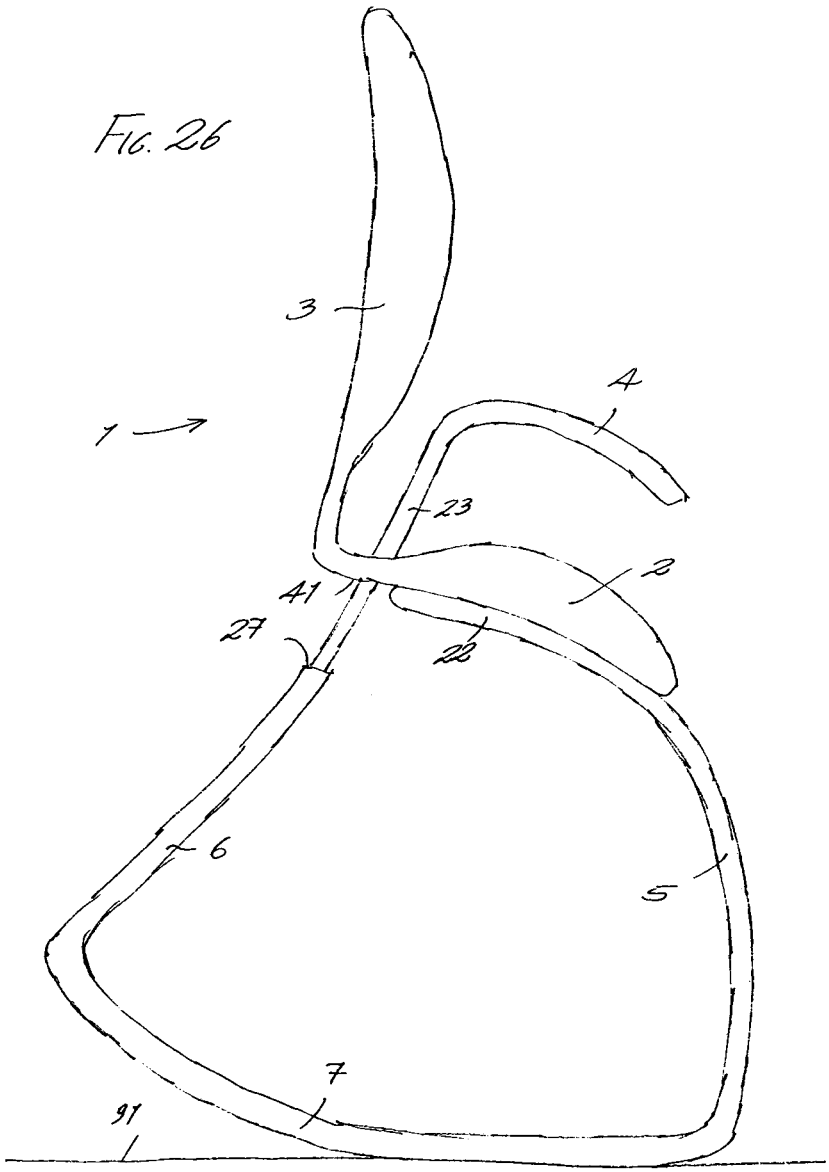
FIG. 26 shows an embodiment of chair in accordance with the invention in which a resilient spring-biased action similar to that achieved by the arrangement of FIGS. 24 and 25 is effected by the frame of support structure of the chair being formed by elongate curved members, with the resilience being provided by the springiness of the bent-around members.

In the unit of FIG. 26, the rocking structure of FIGS. 20 and 21 is combined with the concept of resilient seat mounting of FIGS. 24 and 25 to provide a chair 1 according to the invention in which the entry disposition of the seat 2 is achieved by adapting the centre of gravity of the chair 1 so that its normal empty position is one in which it is disposed so as to receive a user, with the seat 2 in a raised and forward disposition, conveniently placed for entry. The seat 2 is again spring-mounted, but in this case the spring feature is provided by the front limbs 5 of the chair 1 extending upwardly and curving rearwardly from the arcuate floor-engaging members 7 of the chair 1, to support the transversely-mounted seat 2. When the user sits onto the seat 2, this yields under the weight of the user by virtue of a bending action of the front limbs 5, so that the seat 2 sinks and moves rearwards until a comfortable and stable disposition is reached, in which the downward weight force is balanced by the upward force exerted by the sprung front limbs 5 of the chair 1. A stop feature 27 is provided to limit the downward movement of the seat 2, in the event of the user being exceptionally heavy. The stop feature may be effected in a constructionally advantageous manner by the rear limbs 6 of the chair 1 being brought forward and passing through or closely adjacent to the sides of the seat 2, these sides being supported by generally rearwardly oriented continuations 22 of the front limbs 5, and by the rear limbs having a step feature 27 in each case, against which an abutment feature 41 of the seat 2 or the rearward continuations 22 of the front limbs 5 engage at the end of the allowed travel of the seat 2. The rear limbs 6 continue upwardly and forwardly above the stop region 27, to define armrests 4.

Figure 28:
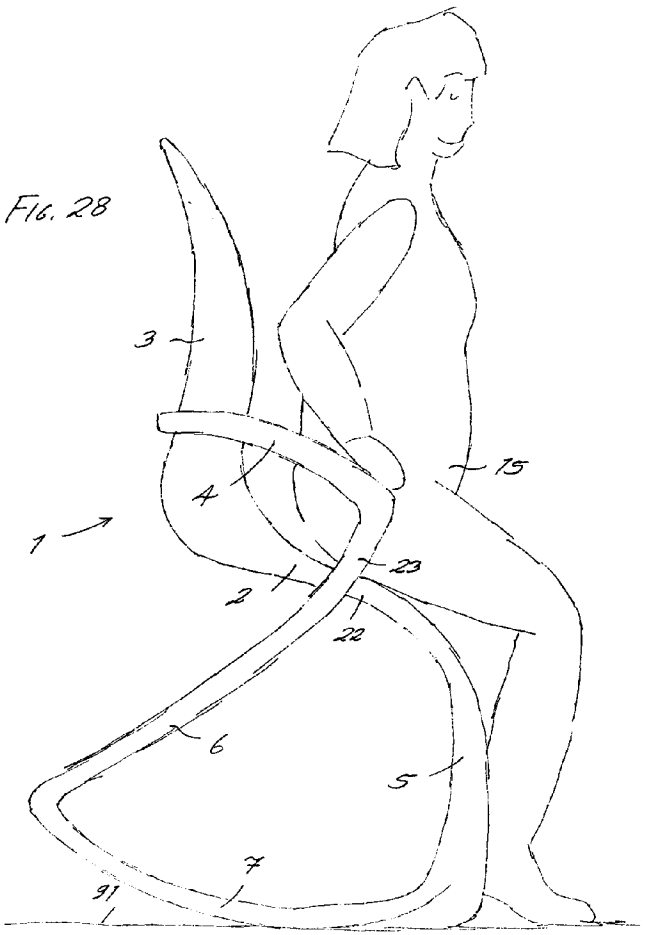
FIGS. 27 and 28 show a variant of the configuration of FIG. 26 in which the curved support members are continuous with the seat of the chair and also define the armrests, while the springiness of the bent-around supports enable displacement of the chair between the reclined disposition of FIG. 27 and the entry/exit orientation of FIG. 28, this latter disposition being also a normal orientation for the chair in the absence of an occupant, by the centre of gravity being suitably selected in conjunction with the partial rocking action afforded by the curved bases of the support members.
Figure 27:
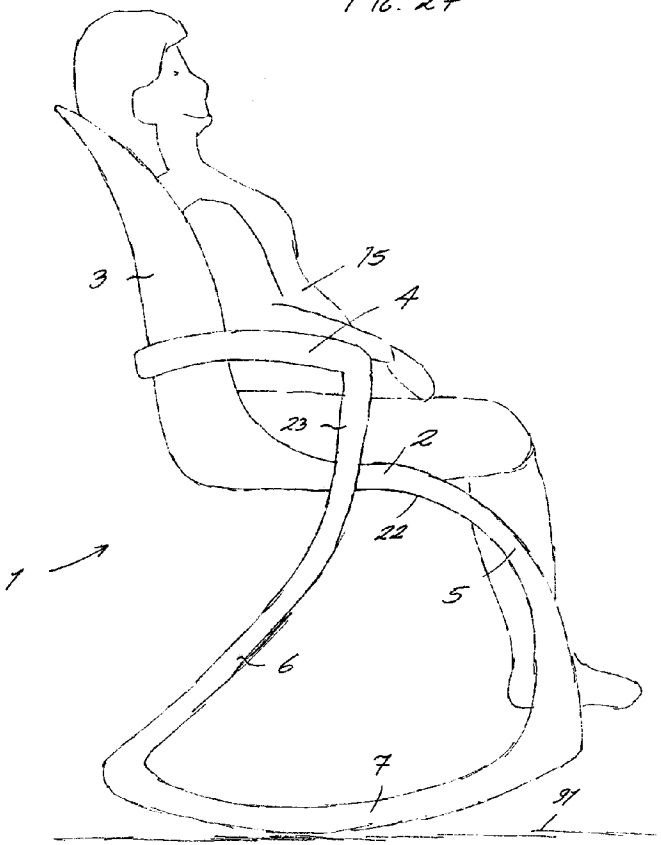

FIGS. 27 and 28 show a variant of the arrangement of FIG. 26. In the previous embodiment, the armrests 4 were brought up at the rear 12 of the seat region 2, as upward continuations 23 of the rear limbs 6, and curved forwardly, towards the front of the chair 1. In the construction of FIGS. 27 and 28, the rear limbs 6 of the chair 1 are brought more towards the front of the chair 1 and then sweep upwardly and rearwardly to define the armrests 4, as compared with the forwardly-directed armrests 4 of FIG. 26. The region of intersection of the front 5 and rear 6 limbs alongside the seat 2 are again adapted to stop limit the downward travel of the seat 2 under the weight force exerted by the user 15, such as by arrangements similar to those of FIG. 26, but not specifically represented in the present Figures. In this embodiment, the integration of front limbs 6 and seat 2/backrest 3 results in a clean and pleasing shape. Entry and exit, depicted in FIG. 28, are also further facilitated by the chair 1 having a limited rocking capability by virtue of the curved floor-engaging supports 7, thus facilitating in particular, movement of the chair into the reclined orientation shown in FIG. 27.

Figure 30:
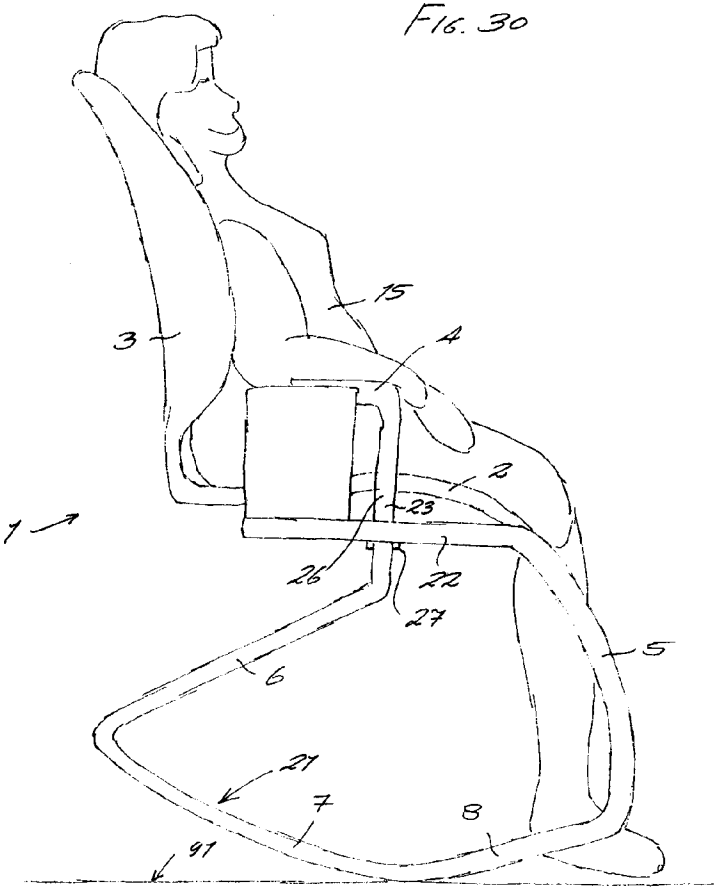
FIGS. 29 and 30 show a chair which functions in a manner similar to that of FIGS. 27 and 28, between an entry/exit disposition as shown in FIG. 29 and a reclining disposition, FIG. 30, the supporting members being however differently profiled from those of FIGS. 27 and 28.
Figure 29:
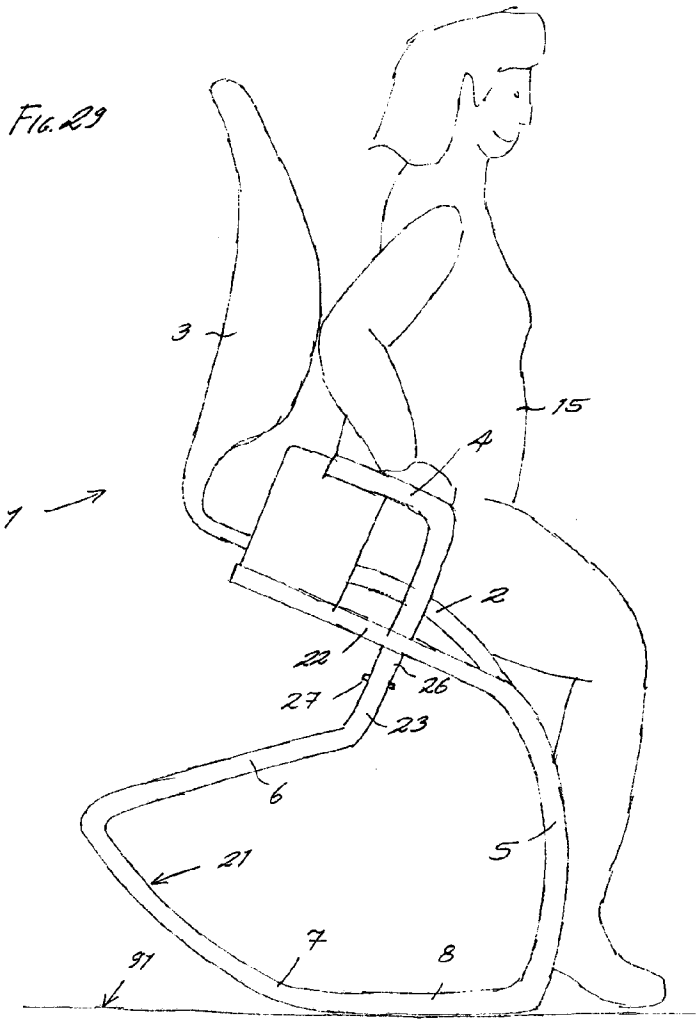

FIGS. 29 and 30 show a variant of the structure of FIGS. 27 and 28 in which the front 5 and rear 6 limbs of the chair 1 are substantially integrated into a single substantially continuously curved or shaped member 21, so that the resilient yielding of the seat supporting elements 5, 6, 7, 21 of the structure under a user's weight is to an extent shared by the entirety of the shaped member 21 defining the limb parts 5, 6 of the unit. The seat 2 is carried on upper rearward runs 22 of the front portions 5 of the continuous limb features 21, while the upper run 23 of the back portion 6 of each continuous limb feature 21 terminates with an upstanding stop-defining portion 26 intersecting and cooperating or interacting with the elongate extent of the upper rearward run 22 of the front portion 5, and then runs out to end at the free ends 24 of the limbs 6 by way of rearwardly extending armrests 4. When the user 15 sits into the chair 1 in the entry configuration shown in FIG. 29, the greater part of the resilient yielding is effected by bending of the front portions 5 of the continuous limb member 21, but the rearward part 6 of this member 21 is also capable of resilient yielding action and in the event of the seat 2 bottoming on stops 27 should the chair 1 be sat on by an exceptionally heavy user 15, the load is then shared by both the front half 5 and the rear half 6 of the generally loop-shaped or carriage-spring-like structure 21 then defined, see FIG. 30. In the forward entry and exit disposition of the chair 1, FIG. 29, linear portions 8 of the ground-support members lie flat on the floor 91, but the chair 1 can tilt back onto a reclining position, as shown in FIG. 30, by user weight transfer, by virtue of the flat profile 8 of the supporting members 7 changing to a curved configuration in the rearward regions of the supports.

Figure 32:
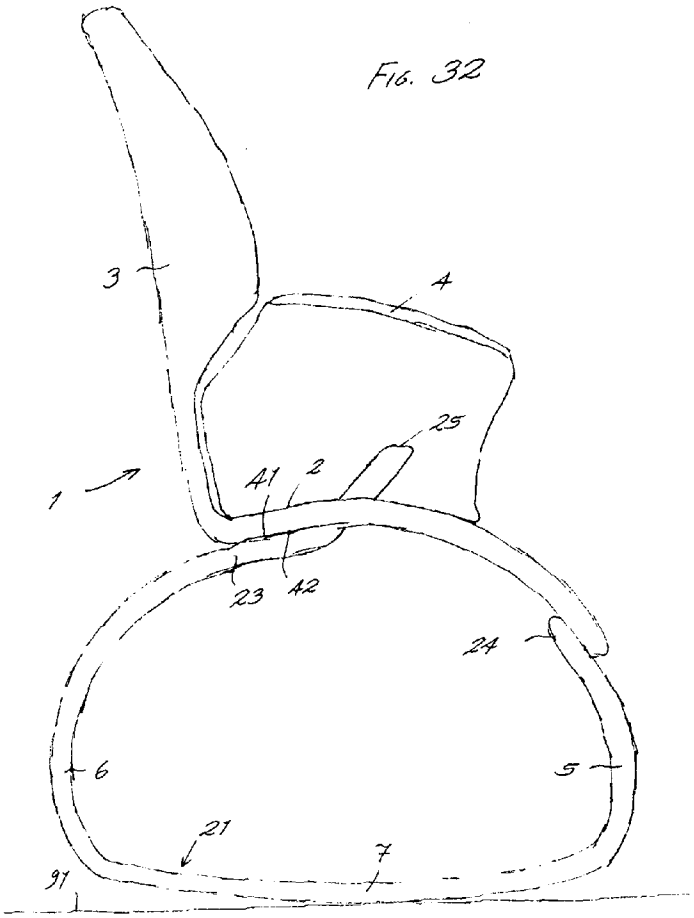

FIGS. 31 and 32 show an arrangement in which the seat 2 is fully independent of the resilient continuous limbs 21. The laminates 21 of the supporting structure fulfil the spring function while the seat 2 and backrest 3 extend in substantially integral continuation of the front free ends 24 of the elongate laminated members 21. The springing action is as described before—when the chair 1 is unoccupied, the seat 2 is raised into a disposition facilitating entry, FIG. 31. When a user sits in, the seat 2 moves downwardly and rearwardly in a controlled manner, as the sprung support members yield, and depending on the weight of the occupant, it either assumes a balanced position in which the weight force is in equilibrium with the spring force of the laminates 21, or the seat travel bottoms out when the laminates 21 and seat 2 come into abutment or contact, i.e. when the underside 41 of the seat 2 engages onto the tops 42 of the forwardly-directed upper runs 23 of the rear portions 6 of the curved limbs 21. Such a disposition is illustrated in FIG. 32. Guidance for this movement may be established by the free ends 25 of the rear portions 6 of the elongate laminates 21 passing through apertures in the sides of the base of the seat 2, or otherwise interacting with the seat 2 in a guided manner. If required, a stop may also be provided at the upper ends of the end regions 23 of rear portions 6, to limit displacement of the seat 2 in the upward direction, this upward movement being effected by the expanding resilience of the curved laminates 21 in the unloaded condition. Limited rocking action is facilitated by gentle curvature of the underlying floor-engaging supports 7.

Figure 34:
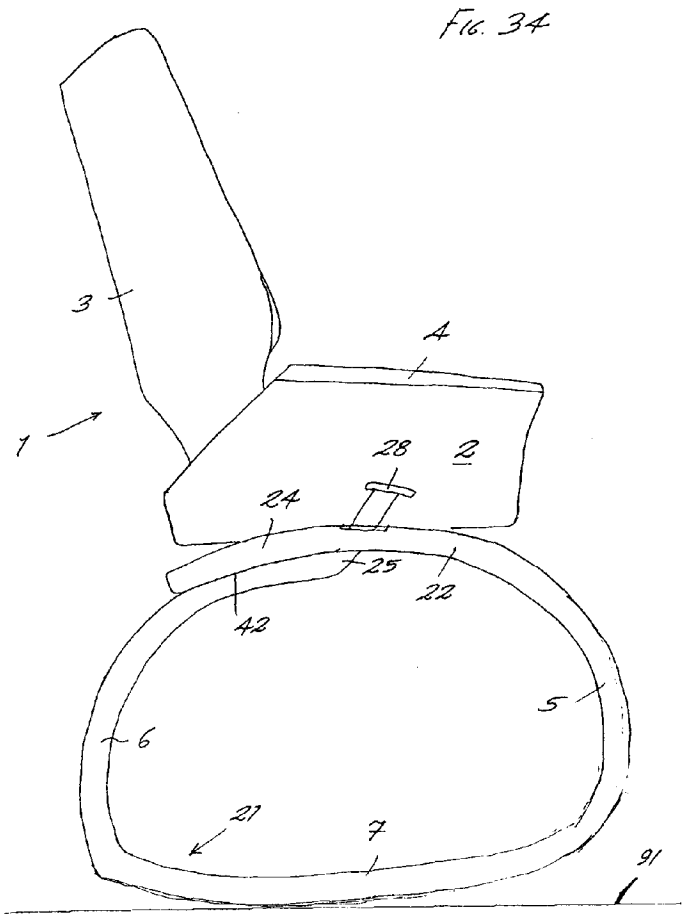
FIGS. 33 and 34 represent a still further variant of the structures of FIGS. 26 to 32, for entry/exit orientation, FIG. 33, and reclining, FIG. 34.
Figure 33:
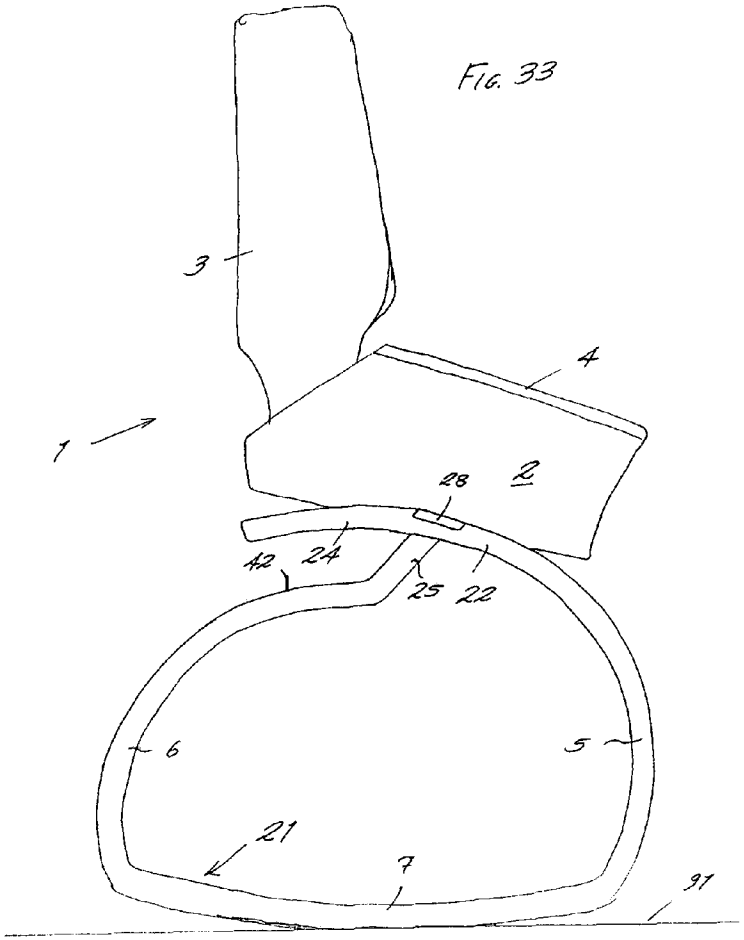

In FIGS. 33 and 34, the seat 2 is now supported directly on rearwardly-directed upper runs 22 of the front regions 5 of the curved elongate resilient spring members 21 (typically laminates) of the supporting structure. Controlled guidance of the resilient displacement is again achieved in this case by the rear portion free ends 25 of the laminates 21 being brought forward and engaging or interacting with the front free end regions 24 of the laminated elongate members 21. Downward displacement of the seat 2 is stop-limited by the upper run 22 reaching and abutting the top 42 of the rear part 6 of each member 21, as shown in FIG. 34, while an end cap 28 or the like similarly stop-limits upward travel and delimits the forward-tilted entry/exit position of the chair 1, in conjunction with the weight balance achieved by choice of materials and seat position, such an orientation being depicted in FIG. 33. Entry and exit is effected by user weight transfer. To exit, the user leans forward and/or extends his or her legs, thereby enabling the springy elongate members 21 of the supporting structure to engender the required upward and forward displacement of the seat 2, in conjunction with limited rocking action enabled by the curved shape of the floor-engaging supports 7.

Figure 36:
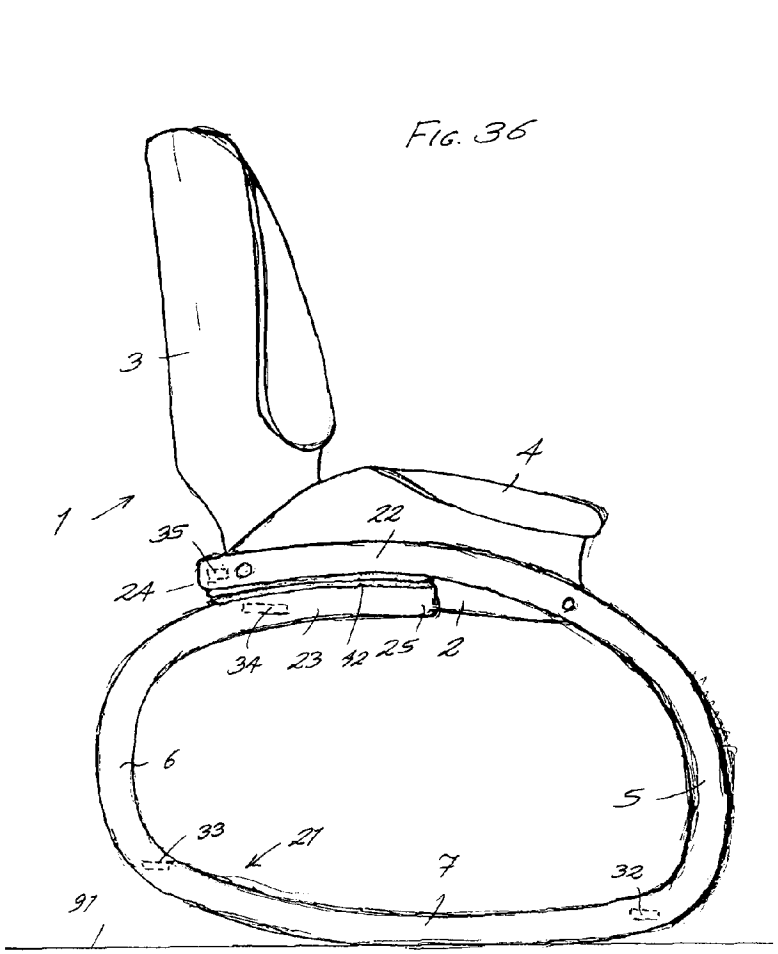
FIGS. 35 and 36 show a favoured variant of the configurations of FIGS. 26 to 34, functioning in essentially the same manner as these previous embodiments, but without the interaction or linking of the opposite ends of the elongate curved support members as represented in the previous FIGS. 26 to 34, the chair in this variant being again depicted in entry/exit condition, FIG. 25, and reclining orientation, FIG. 36.
Figure 35:
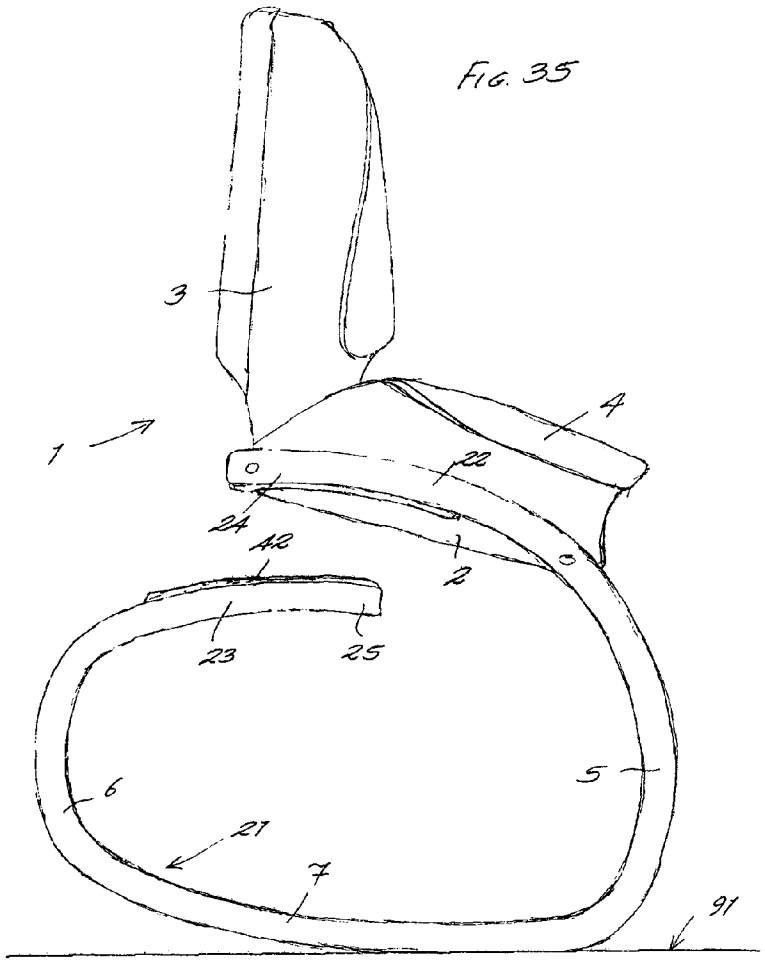

In the embodiment of FIGS. 35 and 36, the guidance of the relative displacement of the ends 24, 25 of the elongate members 21 by means of the interacting upward end portions of the rear portion free ends 25 has been dispensed with and the downward displacement of the seat 2 is terminated solely by abutment of the overlying upper rearward run 22 of each elongate member 21 on the underlying upper side 42 of the wrapped around underlying forwardly oriented termination 25 of the rear free end portion 23, run 23 being the upper forwardly turned back region of rear portion 6 ending at 25. This situation is illustrated in FIG. 36. The underside of the seat 2 and the upper side 42 of region 23 may be cushioned or padded to smooth the action of mutual abutment or bottoming, when the chair is loaded. There is no specific stop to terminate upward movement of the seat 2 and this is established solely by the resilience of the curved laminates 21 which expand towards an unstressed normal configuration when the chair 1 is unloaded, shown in FIG. 35. The maximum extent of this upward movement can be determined by the design and manufacturing parameters of the laminates. The base of the seat 2 is here also located below the level of the rearwardly-directed upper runs 22 of the elongate members 21, thereby providing a tapering guidance of the seat 2 between the upper runs 23 of the rear free end regions 25 of the elongate members 21 during downward displacement of the seat 2 under weight loading by a user. It has been found that the curved elongate spring members 21, connected by transverse stretchers in side by side disposition in parallel planes, have adequate stiffness without necessarily requiring the interacting linking of the rear free end 25 with the front end region 24, such as provided in previous embodiments by way of interengagement or interaction or the rear portions 23 of the curved laminates 21 with the rear end regions 24 of the front portions 5 of the curved limbs 21. The locations for stretchers fulfilling the transverse linking between the members 21 is indicated in FIG. 36 by reference numerals 32, 33, 34 and 35.

Figure 37:
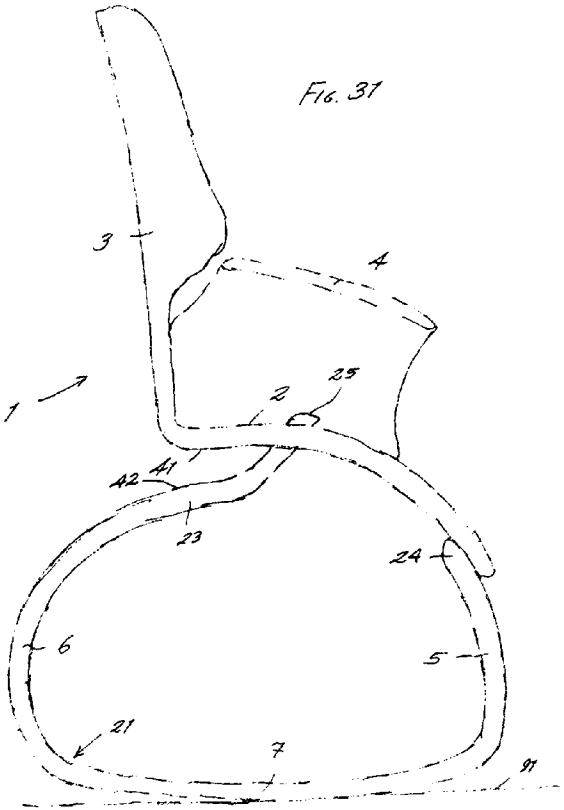
FIG. 37 represents a modification of the embodiment of FIGS. 35 and 36, in which additional spring capacity is provided by a leaf spring interposed between the opposite and overlying ends of the curved support members.

FIG. 37 shows a refinement in which the downward displacement of the seat 2 under the weight of a user and the required upward return movement necessary for assisting exit from the chair 1 may be respectively further controlled and augmented by means of a leaf spring 52, preferably formed from two opposed convexly curved laminates, interposed between the underside 41 of the seat 2 and the forwardly-oriented free end region 25 of the rear 23 of the elongate laminate 21. The cooperative association of this spring 52 and the inherent springiness of the curved supporting structure laminate 21 can be adjusted to optimise the entry/exit assisting action of the chair of the invention. No rocking is provided in this embodiment.

Figure 38:
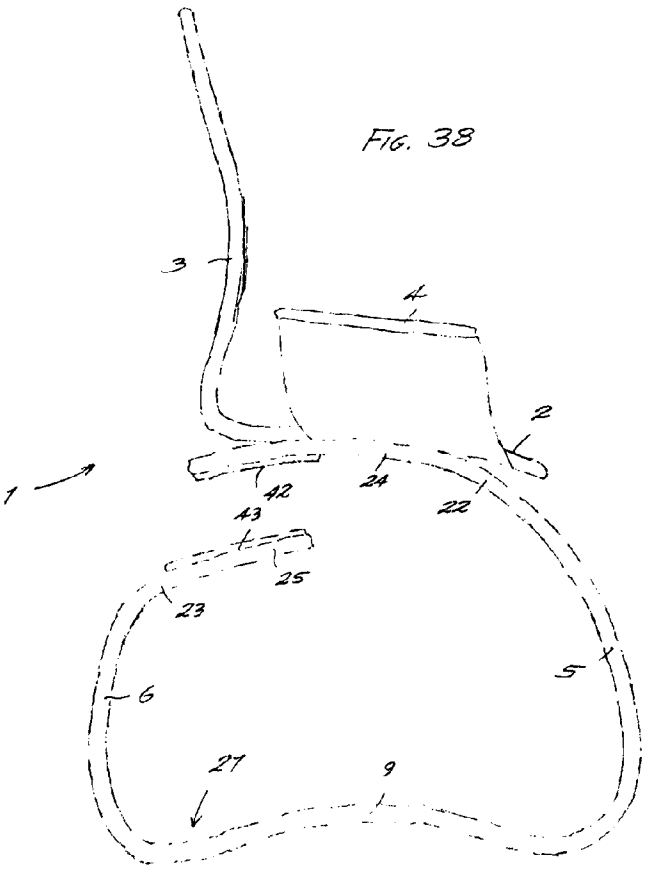
FIG. 38 shows an especially streamlined variant of the structures of FIGS. 26 to 37, in which the seat and backrest are mounted on the uppermost free ends of the elongate curved supports and damping or buffer means are provided to absorb contact action between the free ends of the curved members when these meet under weight loading by a user sitting in the chair.
Figure 37:
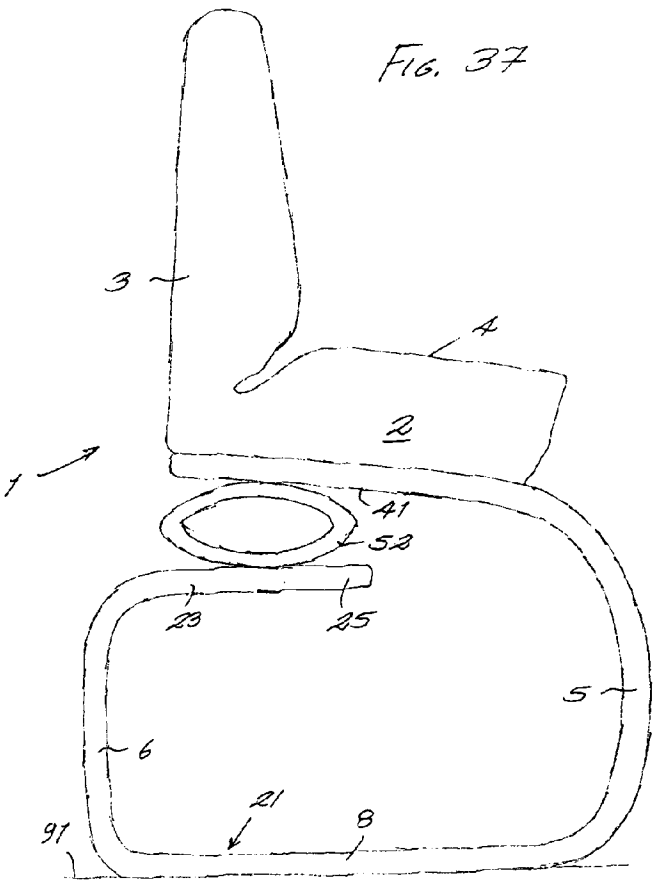
Figure 40:
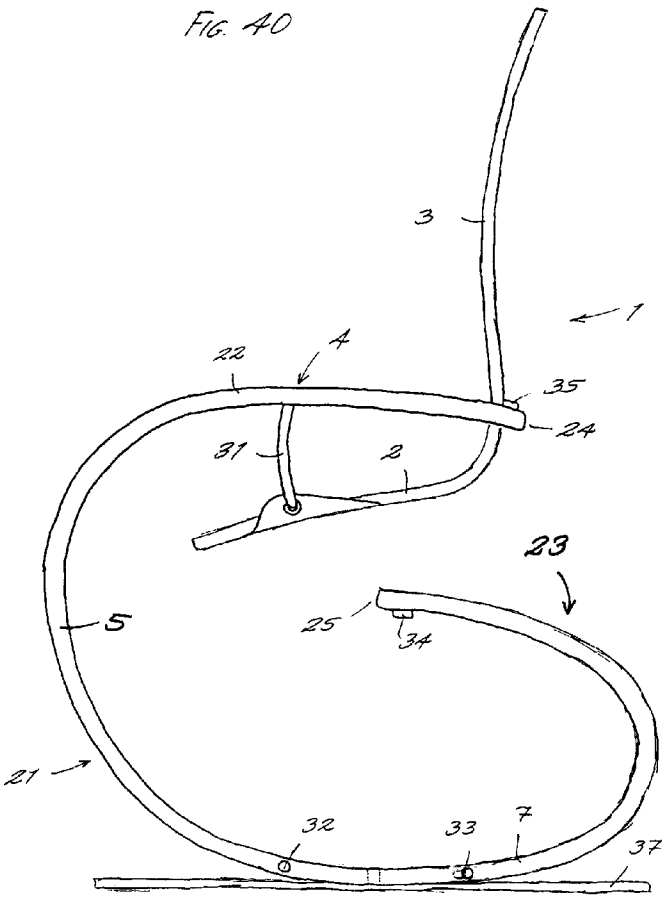
FIG. 40 is a side view of the chair of FIG. 39, showing in particular the partially suspended arrangement of the seat of the unit.

In the configuration of FIG. 38, the floor-engaging portion of the laminated strips 21 forming the supporting structure is provided with a region 9 having reverse curvature as compared with the general convexity of the elongate member 21 as a whole, so that the supporting structure engages the floor 91 at two spaced-apart locations, respectively towards the front and rear of the chair 1. The supporting structure is therefore in this embodiment inhibited from undertaking any rocking action and the entry/exit facility is established solely by deflection of the springy front portions 5 of the elongate members 21 and to an extent optionally also by limited yielding of the rear parts 6 of the elongate members 21 should the seat 2 bottom onto the rear part 23 in stop-limited manner when loaded by a seated user. Buffer portions 42, 43 are provided on the underside of the rear end regions 24 of the upper limbs 22 and on top of the free end regions 25 of the lower limbs 23, to damp bottoming out when the chair 1 is sat on by a heavy user.

Figure 39:
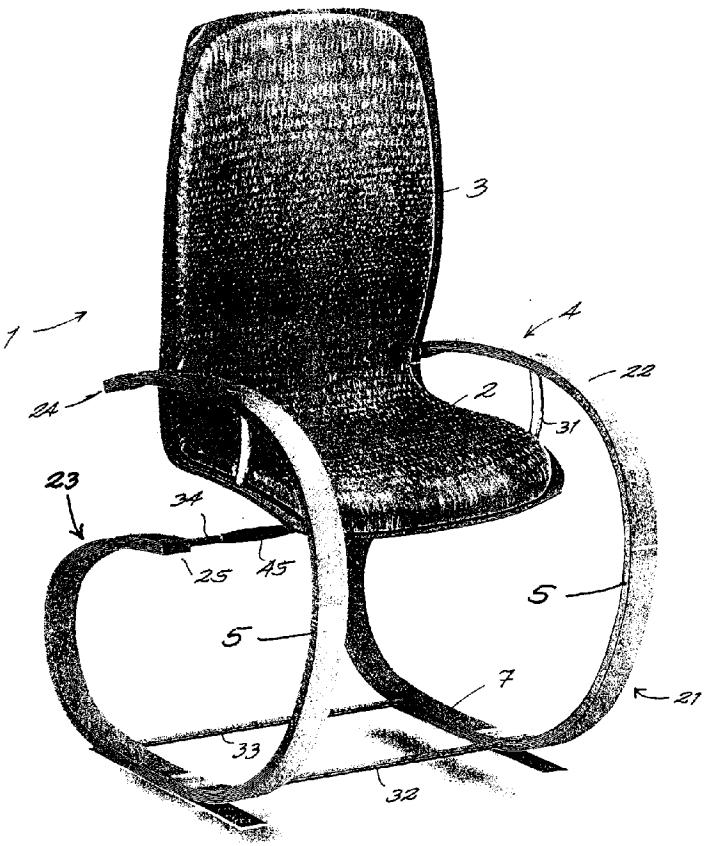
FIG. 39 is a pictorial representation of an especially favoured embodiment of the chair according to the invention, incorporating the principles exemplified by the constructions illustrated in FIGS. 26 to 38 with the resilience of the structure being provided by the elongate curved supporting members.
Figure 44:
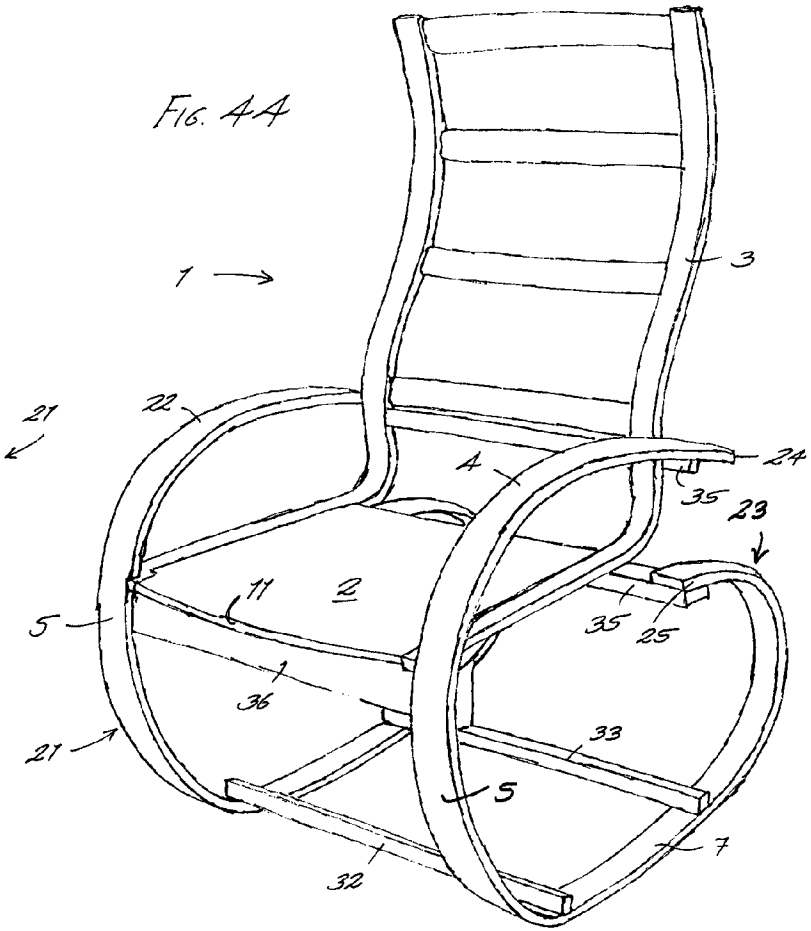
FIG. 44 is a pictorial view similar to FIGS. 39 and 41 showing a variant of the preferred construction of the chair in accordance constitutes a transverse stretcher for the front region of the chair.
Figure 41:
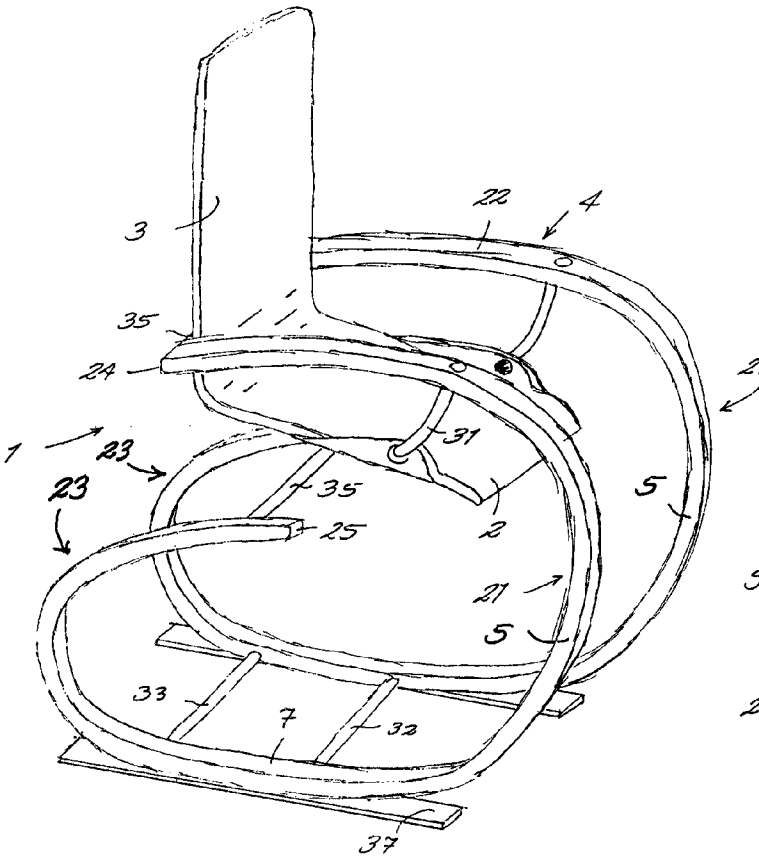
FIG. 41 is a pictorial line drawing of the chair according to the preferred embodiment of the invention, as already depicted in FIGS. 39 and 40.
Figure 43:
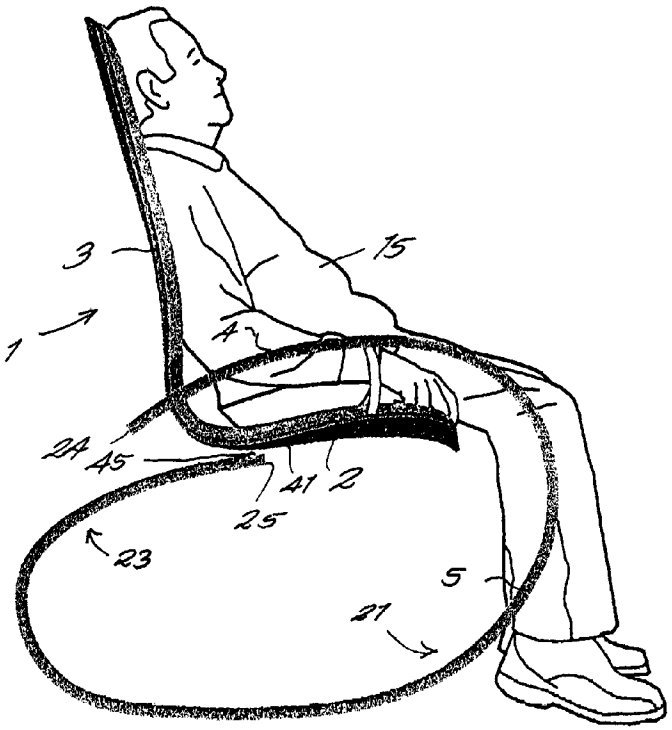
FIG. 43 is a follow-up representation to that of FIG. 42, after the user has sat into the chair and has reclined into it.

FIG. 39 is a pictorial representation of a preferred embodiment of chair 1 in accordance with the invention. FIG. 39 is to be interpreted together with the side view of FIG. 40 and the substantially isometric view of FIG. 41. In this case, each supporting limb of the chair 1 is defined by a single continuously curved spring member 21, suitably a wood laminate, although other materials or composites of metal and wood are also possible. In side view in the unloaded condition, each supporting member 21 has the shape of an open loop, with the free ends 24, 25 of the member 21 being spaced apart vertically and located substantially one above the other in the normal or unloaded orientation of the member 21. Also in this view and orientation, there is a short overlap between the free ends 24, 25, so that the upper free end 24 is seen as overlying the lower free end 25, when viewed from above.

As compared with the previous embodiments, the seat 2 is now suspended by downwardly-dropping brackets 31 from the rearward upper runs 22 extending from the front upwardly curving regions 5 of the limb members 21, so that these upper runs 22 now also define the armrests 4 of the chair 1. Lateral stiffness is achieved by two or more stretcher bars 32, 33 extending transversely between the curved spring members 21 in their lower regions 7 where they run in proximity to an underlying surface on which the chair 1 is to be supported, and at least one further stretcher 34 extends between the members 21 close to the free ends 25 of the members 21 that do not form the armrests 4. Transverse stiffness is also provided by a stretcher 35 to the rear of the backrest 3, or stretcher action is achieved by the backrest 3 itself.

The lower runs 24 of the spring supports 21 may optionally be underlaid by base stands 37, which may be secured to the spring members 21 in this region 7. The base stands 37 suitably comprise stainless steel strip members, which, when associated with the spring members 21 such as by a suitable securing method, e.g. fasteners, inhibit any rocking motion of the chair 1. The base stands 37 are suitably selectively attachable to the unit, so that if a degree of rocking action is desired, they may be omitted from the assembly. Preferably, the floor-engaging portions 7 of the curved spring members 21, which may also be associated with the base stands 37, have a relatively slight degree of curvature over their elongate extent, so that the amount of rocking action achievable is modest.

Figure 42:
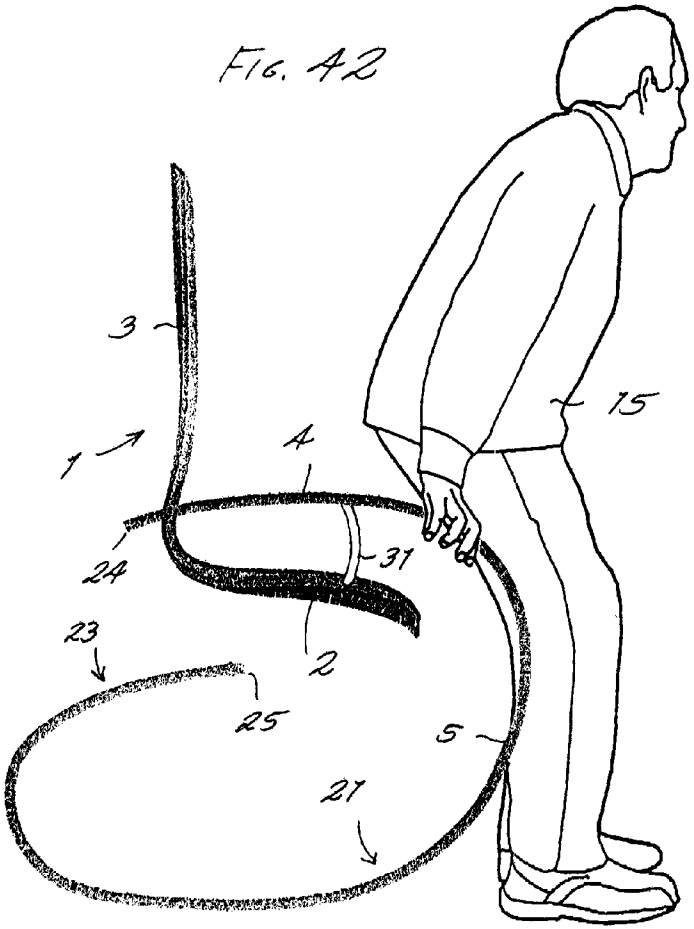
FIG. 42 shows the chair of the preferred configuration of FIGS. 39 to 41 in the entry/exit condition, with a user about to sit into it.

The easy entry and exit facility of the chair 1 in this embodiment is achieved almost entirely by the spring action of the continuous support members or laminates 21, with possible optional augmentation by limited rocking action, where provided or not inhibited by base stands 37. The curvature and resilience or springiness of the side members 21 is specified and realised such that in the unloaded condition of the chair 1, the seat 2 occupies an upward and forwardly tilted disposition, which is conveniently and comfortably placed as to height and angle for the user requiring to sit into the chair 1. This can be seen in FIG. 42 in particular. As shown in FIG. 42, the user 15 backs into the chair 1 in conventional posture, may grasp the armrests 4 if desiring to do so, and as he or she sits down, the user's thighs and buttocks encounter the seat 2 at a comfortable height and with a convenient angle of tilt. As the user 15 sits fully into the chair 1, the spring members 21 yield under his or her weight, see FIG. 43. Depending on the user's weight and the spring characteristics of the assembly, the seat 2 may come into equilibrium before it encounters stop members in the form of resilient elements 45 on the upper stretcher 34 of the rear of the support structure, but if the user 15 is heavy, or the chair 1 has been designed to be highly resilient and springy, the seat 2 may bottom onto these stop elements 45, which may suitably be rubber sleeves on a bar-shaped stretcher 34. Under these conditions, the initially open spring structure 21 takes up a closed configuration and its further behaviour will resemble to some extent that of a carriage spring, with resilience and yielding being delivered by the now substantially closed-loop laminate structure 21.

The structure is balanced and arranged such that it is stable for a forwardly tilted orientation of the seat 2 when unoccupied and is similarly stable when the user 15 reclines against the backrest 3, but with the seat 2 then sloping downwardly to the rear. This configuration is clearly apparent in FIG. 43.

In order to exit from the chair 1, the user 15 leans forward, thereby shifting the combined centre of gravity of chair 1 and user 15 forward, so that the spring members 21 are then able to rise again towards their unloaded disposition, thus causing the seat 2 to rise and assist the user 15 in standing up out of the chair 1 and exiting from it. At least when the chair 1 has a degree of rocking action available, this exiting action may be initiated simply by the user 15 stretching his or her legs forwardly, away from the chair, this small shift in weight distribution sufficing to effect the assist action on the part of the spring members 21.

This ease of entry and exit is of benefit to all users, but in particular assists those who may be disabled or encumbered. It is especially effective for elderly but frail persons, as well as pregnant women and nursing mothers. The chair facilitates sitting down and rising up on the part of users who are encumbered or supporting for example a child or infant. The smooth take-up of body weight by the sprung structure means that the user can have confidence in being supported at an earlier stage in a sitting action, while the rising motion of the chair for the exiting user provides a similar assurance for this exit movement.

Front end lateral stiffness can be achieved by appropriate formation of the laminate or strip members 21 in this region to have individual resistance to sidewise or twisting motions. The manner of attachment or suspension of the seat 2 may also serve to enhance lateral stiffness, such as by means of a U-member which comprises bracket portions 31, but also links the side strips 21 by portions underlying the seat 2. In a variant, illustrated in FIG. 44, the seat 2 and backrest 3 are repositioned so that the front edge 11 of the seat 2 extends transversely between the curved side spring members 21 in the vicinity of the location 5 where the curvature turns back to define the armrests 4. The front edge 11 of the seat 2 may be underlaid in this region by a further stretcher 36. The backrest 3 is then disposed somewhat further forwardly than in the embodiment of FIGS. 39, 40, 41, 42 and 43, and the weight distribution of the unloaded/unoccupied chair 1 is then adjusted and adapted so that the desired forward tilt in this condition is again achieved. This variant of the invention functions essentially in precisely the same manner as that of FIGS. 39, 40, 41, 42 and 43, but provides additional transverse stiffness for the upward sweep 5 of the curved spring supports 21 at the front of the chair 1, as compared with the integrally achieved stiffness of the construction of the former figures.

The invention claimed is:

1. A chair that facilitates entry and exit for a user, the chair comprising:
- a seat;
- a backrest; and
- an underlying support structure supporting the seat and the backrest,
- wherein the support structure comprises a first elongated spring member that:
  - has an open-loop configuration, in an unloaded state of the chair, defined by a substantially continuous convex curvature between a first free and a second free end thereof;
  - has an upper run terminating at the first free end, and a lower run terminating at the second free end, with the upper run of the first elongated spring member carrying the seat and the backrest;
  - is biased into a configuration in which, in the unloaded state of the chair, the first and second free ends are spaced apart vertically from one another while overlapping horizontally with each other, with the first free end located above the second free end, and with the seat in a forwardly tilted disposition to facilitate the user to more easily sit on the chair; and
  - is resiliently yieldable under user weight into a configuration, in a loaded state of the chair, so that when the user sits on the chair, the first free end approaches or comes into engagement with the second free end and moves the seat out of the forwardly tilted disposition.

2. The chair according to claim 1, wherein an amount of deflection of the first elongated spring member between the unloaded condition and the loaded condition of the chair is effected by a weight of the user.

3. The chair according to claim 1, wherein the first free end of the first elongated spring member interacts with the second free end of the first elongated spring member to limit deflection of the upper run of the member relative to the lower run, upon which the first elongated spring member is configured in a closed-loop state, where the resiliency of the first elongated spring member changes from that in the open-loop state.

4. The chair according to claim 3, wherein a limit of the deflection is established by engagement of the upper run against the lower run in the region of the first and second free ends.

5. The chair according to claim 3, further comprising:
- at least one resilient stop member positioned between the region of the first free end and the second free end,
- wherein a limit of the deflection is effected by engagement of the seat against the at least one resilient stop member.

6. The chair according to claim 1, wherein the lower run has a portion with a relatively slight degree of convex curvature.

7. The chair according to claim 1, wherein the lower run of the first elongated spring member has a lower portion with the convex curvature that is sufficient to enable at least a limited rocking action of the chair relative to an underlying floor surface.

8. The chair according to claim 7, wherein the center of gravity of the chair is located to tilt the chair forward into an entry/exit orientation in the unloaded condition.

9. The chair according to claim 1, wherein the support structure comprises a second elongated spring member that is substantially identical to the first elongated spring member.

10. A chair that facilitates entry and exit for a user, the chair comprising:
- a seat;
- a backrest; and
- an underlying support structure supporting the seat and the backrest,
- wherein the support structure comprises a first elongated spring member that:
  - has an open-loop configuration, in an unloaded state of the chair, defined by a substantially continuous convex curvature between a first free and a second free end thereof;
  - has an upper run terminating at the first free end, and a lower run terminating at the second free end, with the upper run of the first elongated spring member carrying the seat and the backrest;
  - is biased into a configuration in which, in the unloaded state of the chair, the first and second free ends are spaced apart vertically from one another while overlapping horizontally with each other, with the first free end located above the second free end, and with the seat in a forwardly tilted disposition to facilitate the user to more easily sit on the chair; and
  - is resiliently yieldable under user weight into a configuration, in a loaded state of the chair, so that when the user sits on the chair, the first free end approaches or comes into engagement with the second free end and moves the seat out of the forwardly tilted disposition, wherein an amount of deflection of the first elongated spring member between the unloaded condition and the loaded condition of the chair is effected by a weight of the user, wherein the first free end of the first elongated spring member interacts with the second free end of the respective elongated spring member to limit deflection of the upper run of the member relative to the lower run, upon which the first elongated spring member is configured in a closed-loop state, where the resiliency of the first elongated spring member changes from that in the open-loop state, wherein the lower run of the first elongated spring member has a lower portion with the convex curvature that is sufficient to enable at least a limited rocking action of the chair relative to an underlying floor surface, wherein the lower portion has a relatively slight degree of convex curvature, and wherein the center of gravity of the chair is located to tilt the chair forward into an entry/exit orientation in the unloaded condition.

11. The chair according to claim 10, wherein the support structure comprises a second elongated spring member that is substantially identical to the first elongated spring member.

* * * * *